US006968147B2

(12) United States Patent
Matsuda et al.

(10) Patent No.: US 6,968,147 B2
(45) Date of Patent: Nov. 22, 2005

(54) PROCESS CARTRIDGE WHOSE SEALING TAPE IS REMOVED WHEN MOUNTED TO IMAGE FORMING APPARATUS AND IMAGE FORMING APPARATUS TO WHICH THE CARTRIDGE IS MOUNTED

(75) Inventors: Kenji Matsuda, Numazu (JP); Akiyoshi Fujita, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 116 days.

(21) Appl. No.: 10/670,235

(22) Filed: Sep. 26, 2003

(65) Prior Publication Data

US 2004/0062573 A1 Apr. 1, 2004

(30) Foreign Application Priority Data

Sep. 30, 2002 (JP) ..... 2002-287438

(51) Int. Cl.[7] ..... G03G 15/08
(52) U.S. Cl. ..... 399/258; 399/262
(58) Field of Search ..... 399/252, 258, 399/260, 262; 222/DIG. 1

(56) References Cited

U.S. PATENT DOCUMENTS

| | | | | |
|---|---|---|---|---|
| 5,528,341 | A | 6/1996 | Shishido et al. | 355/200 |
| 5,642,187 | A | 6/1997 | Nomura et al. | 399/111 |
| 5,650,841 | A | 7/1997 | Matsuda et al. | 399/111 |
| 5,678,139 | A | 10/1997 | Nomura et al. | 399/114 |
| 5,697,022 | A | 12/1997 | Matsuda et al. | 399/102 |
| 5,825,472 | A | 10/1998 | Araki et al. | 355/200 |
| 5,963,759 | A | 10/1999 | Kojima et al. | 399/111 |
| 6,016,408 | A | 1/2000 | Hashimoto et al. | 399/27 |
| 6,101,352 | A | 8/2000 | Hashimoto et al. | 399/119 |
| 6,151,459 | A | 11/2000 | Hashimoto et al. | 399/27 |
| 6,314,262 | B1 * | 11/2001 | Kunihiro et al. | 399/258 |
| 6,324,370 | B1 | 11/2001 | Isobe et al. | 399/258 |
| 6,564,029 | B2 | 5/2003 | Kojima et al. | 399/258 |
| 6,668,145 | B2 * | 12/2003 | Wang et al. | 399/258 |
| 6,721,525 | B2 * | 4/2004 | Wang et al. | 399/258 |
| 6,839,534 | B2 * | 1/2005 | Matsuda et al. | 399/262 |
| 2002/0141788 | A1 | 10/2002 | Matsuda et al. | 399/260 |
| 2003/0133723 | A1 | 7/2003 | Fujita et al. | 399/111 |

FOREIGN PATENT DOCUMENTS

| | | |
|---|---|---|
| JP | 2000-221854 | 8/2000 |

* cited by examiner

*Primary Examiner*—Hoan Tran
(74) *Attorney, Agent, or Firm*—Fitzpatrick, Cella, Harper & Scinto

(57) ABSTRACT

A cartridge is detachably mountable to a main assembly of an electrophotographic image forming apparatus. The cartridge includes a developer accommodating portion, a developer supply port supplying the developer to a developing device for developing an electrostatic latent image formed on an electrophotographic photosensitive member, a removable sealing tape sealing the developer supply port, and a covering member taking an opening position for opening the port and a closing position for closing the port and to which one longitudinal end of the tape is fixed, the covering member being effective to cover the tape sealing the port when it is at the closing position, and cartridge locking portion for locking the covering member at the closing position. When the cartridge is mounted to the main assembly of the apparatus, locking between the cartridge locking portion and the covering member is released by engagement between the covering member and the main assembly, and the covering member moves from the closing to the opening position, and the tape is removed from the port to open the port.

15 Claims, 15 Drawing Sheets

PROCESS CARTRIDGE WHOSE SEALING TAPE IS REMOVED WHEN MOUNTED TO IMAGE FORMING APPARATUS AND IMAGE FORMING APPARATUS TO WHICH THE CARTRIDGE IS MOUNTED

FIELD OF THE INVENTION AND RELATED ART

The present invention relates to a cartridge removably mountable in the main assembly of an electrophotographic image forming apparatus, and an electrophotographic image forming apparatus in which the cartridge is removably mountable.

A cartridge removably mountable in the main assembly of an electrophotographic image forming apparatus has been widely known (for example, Japanese Laid-open Patent Application 2000-221854). Here, an electrophotographic image forming apparatus is an apparatus for forming an image on recording medium with the use of an electrophotographic image forming method. As examples of an electrophotographic image forming apparatus, there are electrophotographic copying machines, electrophotographic printers (laser beam printers, LED printers, etc.), facsimile machines, word processors, etc.

A cartridge is a cartridge having a minimum of a storage portion for storing developer used by a developing means. There is a cartridge system in which a cartridge is removably mounted in the main assembly of an electrophotographic image forming apparatus. It has been in use in recent years.

The cartridge system substantially improves the operability of an electrophotographic image forming apparatus. In particular, it made it possible for a user to maintain by himself the components of an electrophotographic image forming apparatus, which contribute to the image formation process. Thus, a cartridge system has come to be widely used in the field of an image forming apparatus.

Some image forming apparatus components that directly contribute to an image formation process have longer service lives than others. Therefore, such a cartridge system has been realized that the components with a shorter service life are placed in one type of a cartridge, and the components with a longer service life are placed in another type of cartridge. For example, a development cartridge (development unit) in which a developer storage portion and a developing means are integrally disposed in a cartridge, a drum cartridge (drum unit) in which an electrophotographic photoconductive member (photoconductive drum), a charging means, and a cleaning means, are integrally disposed in a cartridge, and the like cartridges, are currently in use.

A cartridge having a developer storage portion for storing developer has an outlet (discharge hole) through which the developer in the developer storage portion is supplied (discharged) to a developing means. It is a common practice to keep this outlet sealed with a sealing tape which can be peeled. This practice has an advantage in that it can prevent the toner deterioration in a developer storage portion. When a cartridge sealed with the above described method is put to use by a user, the user is to remove this sealing tape to expose the opening of the outlet so that the cartridge can be used.

It is not unreasonable to think that it is feasible to provide a cartridge, the developer outlet of which is kept sealed with a sealing tape until the cartridge is used for the very first time, with such a structural arrangement that the sealing tape is automatically peeled away by the mounting of the cartridge into the main assembly of an image forming apparatus.

For example, the sealing tape can be automatically peeled by providing a cartridge with a cartridge cover which is moved by the mounting movement of the cartridge, and fixing one end of the sealing tape to the cartridge cover. With this structural arrangement, as the cartridge cover is moved by the mounting movement, of the cartridge, the sealing tape is peeled by the movement of the cartridge cover.

This structural arrangement, however, causes concern in that a cartridge is sometimes subjected to shocks during shipment or the like, that is, before it is used for the very first time, and as a cartridge is subjected to shocks or the like, its cartridge cover is moved by the shocks, peeling thereby the sealing tape, allowing thereby developer to leak.

SUMMARY OF THE INVENTION

The primary object of the present invention is to provide a cartridge, the sealing tape of which is easily removably before it is used for the very first time, and an electrophotographic image forming apparatus in which the cartridge is removably mountable.

Another object of the present invention is to provide a cartridge which does not have the problem that the developer therein leaks due to an accidental removal of its sealing tape, and an electrophotographic image forming apparatus in which the cartridge is removably mountable.

Another object of the present invention is to provide a cartridge which can be reduced in size, and an electrophotographic image forming apparatus in which the cartridge is removably mountable.

Another object of the present invention is to provide a cartridge, the cover of which smoothly moves when the cartridge is mounted into the main assembly of an electrophotographic image forming apparatus, and an electrophotographic image forming apparatus in which the cartridge is removably mountable.

Another object of the present invention is to provide a cartridge which is removably mountable in the main assembly of an electrophotographic image forming apparatus, and comprises: a developer storage portion for storing developer; a developer outlet through which the developer in the developer storage portion is supplied to a developing means for developing an electrostatic latent image formed on an electrophotographic photoconductive member; a removable sealing tape for sealing the developer outlet; a covering member, which is capable of taking the open position in which it exposes the developer outlet, and the closed position in which it seals the developer outlet, and covers the sealing tape, and to which one end of the sealing tape is fixed; and a covering member retaining portion for retaining the covering member in the closed position; wherein the covering member is disengaged from the covering member retaining portion by the engagement of the covering member with the main assembly of the image forming apparatus, which occurs during the initial stage of the insertion of the cartridge into the main assembly of the image forming apparatus, and the sealing tape is removed, exposing thereby the opening of the developer outlet, by the movement of the covering member from the closed position to the opening position, which occurs after the initial stage of the insertion of the cartridge into the apparatus main assembly.

Another object of the present invention is to provide an electrophotographic image forming apparatus in which a cartridge is removably mountable, and which is for forming an image on recording medium, comprising: (i) a mounting means for removably mounting a cartridge comprising: a developer storage portion for storing developer; a developer outlet through which the developer in the developer storage portion is supplied to a developing means for developing an electrostatic latent image formed on an electrophotographic photoconductive member; a removable sealing tape for sealing the developer outlet; a covering member which is capable of taking the open position in which its exposes the developer outlet, and the closed position in which it seals the developer outlet, and covers the sealing tape, and to which one end of the sealing tape is fixed; and a covering member retaining portion for retaining the covering member in the closed position; and (ii) a conveying means for conveying recording medium; wherein the covering member of the cartridge is disengaged from the covering member retaining portion by the engagement of the covering member with the main assembly of the image forming apparatus, which occurs during the initial stage of the insertion of the cartridge into the main assembly of the image forming apparatus, and the sealing tape is removed, exposing thereby the opening of the developer outlet, by the movement of the covering member from the closed position to the opening position, which occurs after the initial stage of the insertion of the cartridge into the apparatus main assembly.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, the preferred embodiments of the present invention will be described in detail with reference to the appended drawings. Incidentally, the measurements, materials, shapes, of the structural components, the positional relationship among them, etc., in the following embodiments of the present invention are not intended to limit the scope of the present invention, unless specifically noted.

In the following descriptions of the present invention, the lengthwise direction is a direction parallel to the axial direction of an electrophotographic photoconductive drum (which hereinafter will be referred to as photoconductive drum 2). Further, with reference to the direction in which a cartridge is inserted into an electrophotographic image forming apparatus, the side toward which a cartridge is inserted will be referred to as the back side, and the side toward which a cartridge is extracted (upstream side with reference to cartridge insertion direction) will be referred to as the front side. Further, the top or bottom side of a cartridge is the top or bottom side of a cartridge properly disposed in the main assembly of an electrophotographic image forming apparatus.

[General Description of Image Forming Apparatus]

Figure 1:
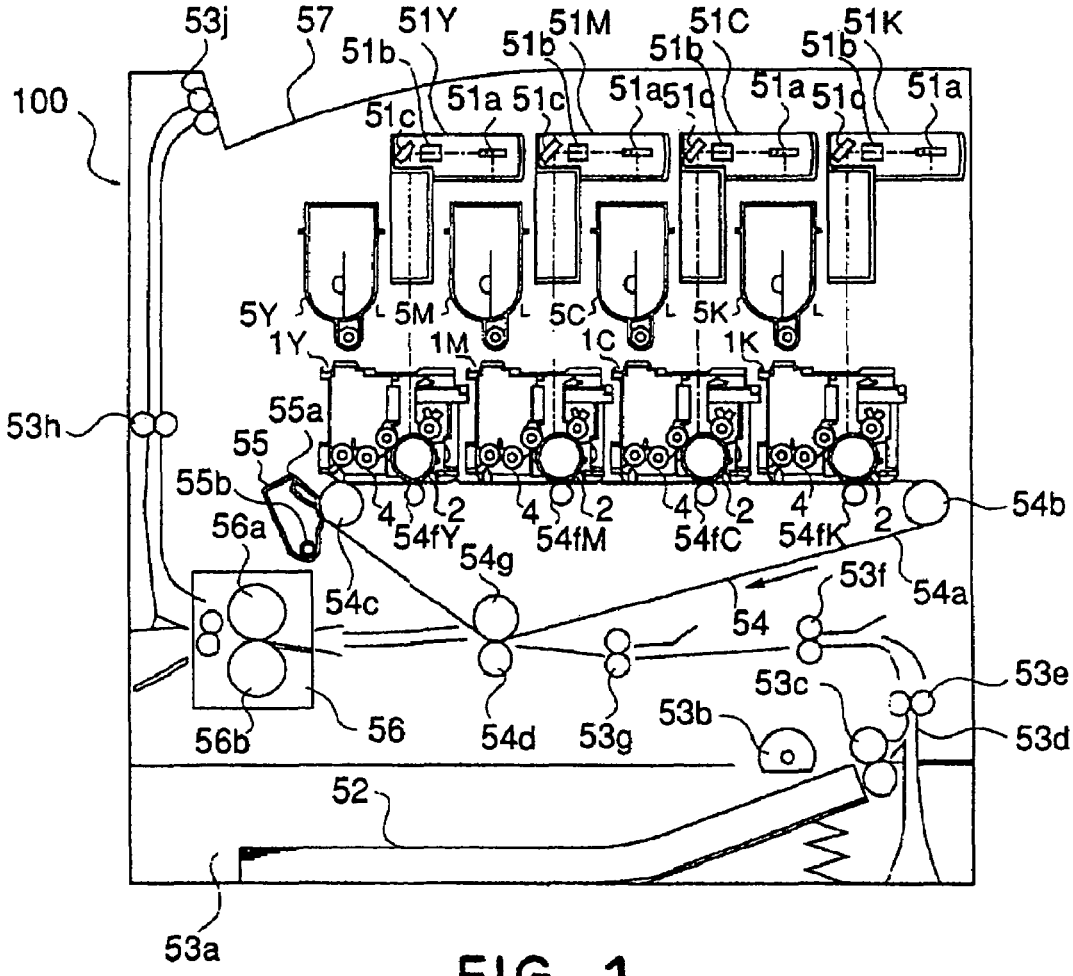
FIG. 1 is a vertical sectional view of the image forming apparatus in the first embodiment of the present invention.

First, referring to FIG. 1, the general structure of a typical electrophotographic color image forming apparatus will be described. FIG. 1 is a drawing for describing the general structure of a color laser beam printer (which hereinafter may be simply referred to as image forming apparatus), that is, one form of an electrophotographic color image forming apparatus.

The image forming portion of this color laser beam printer in this embodiment employs four process cartridges 1 (1Y, 1M, 1C, and 1K corresponding to yellow, magenta, cyan, and black color components, respectively), each of which has a photoconductive drum 2 as an image bearing member. The image forming portion also has four exposing means (laser beam optical scanning system) (51Y, 51M, 51C, and 51K), which are disposed in parallel and are aligned in the horizontal direction. The four exposing means are located above the process cartridges 1 (1Y, 1M, 1C, and 1K), being roughly vertically aligned one for one with the four process cartridges 1.

Disposed below the above described image forming portion is a feeding means for feeding a recording medium 52 into the main assembly, an intermediary transfer belt 54*a* onto which a toner image formed on the photoconductive drum 2 is transferred, and a secondary transfer roller 54*d* for transferring the toner images on the transfer belt 54*a*, onto the recording medium 52.

The image forming apparatus is also provided with a fixing means for fixing the toner images which have been transferred onto the recording medium 52, and a discharging means for discharging the recording medium 52 out of the image forming apparatus main assembly and accumulating it. The recording medium 52 is, for example, a piece of recording paper, OHP sheet, fabric, or the like.

The image forming apparatus in this embodiment is a cleaner-less apparatus. Thus, the transfer residual toner, that is, the toner remaining on the photoconductive drum 2 after transfer is taken in by the developing means. Therefore, the process cartridge 1 is not provided with a cleaner dedicated to the recovery and storage of the transfer residual toner.

Next, the structures of the various portions of the image forming apparatus will be described in detail in the logical order.

[Feeding Portion]

The feeding portion is a portion for conveying the recording medium 52 to the image forming portion. It essentially comprises: a feeding cassette 53*a* which holds a plurality of recording media 52; a feed roller 53*b*; a pair of retard rollers 53*c* for preventing two or more recording media 52 from being fed at the same time; a guide 53*d*; and a pair of registration rollers 53*g*.

The feeding roller 53*b* is rotationally driven in synchronism with an image forming operation, taking the recording media 52, virtually one by one, out of the feeding cassette 53*a* and feeding them into the apparatus main assembly. As the recording media 52 are fed into the apparatus main assembly, they are prevented by the retard rollers 53*c* from being fed at the same time. Then, the recording media 52 are conveyed to the registration rollers 53*g*, by way of conveyance rollers 53*e* and 53*f*, while being guided by the conveyance guide 53*d*.

During an image forming operation, the registration rollers 53*g* repeat the sequence of being kept stationary for keeping a recording medium 52 on standby, and being rotated for conveying the recording medium 52 toward the intermediary transfer belt 54*a*, in order to align a toner image with the recording medium 52 during the subsequent transfer process.

Immediately after the release of the recording medium 52, the rotation of the registration rollers 53*g* is stopped, and the registration rollers 53*g* are again kept stationary. Then, the following recording medium 52 collides with the nip portion between the two registration rollers 53*g*, being thereby unslanted.

[Process Cartridge]

A process cartridge is a cartridge in which a charging means, and a developing means or cleaning means, are integrally disposed along with an electrophotographic photoconductive drum, and which is removably mountable in the main assembly of an electrophotographic image forming apparatus, or a cartridge in which at least one means among a charging means, a developing means, and a cleaning means, is integrally disposed along with an electrophotographic photoconductive drum, and which is removably mountable in the main assembly of an electrophotographic image forming apparatus. It also is a cartridge in which a minimum of a developing means is integrally disposed along with an electrophotographic photoconductive drum, and which is removably mountable in the main assembly of an electrophotographic image forming apparatus.

In this embodiment, the image forming apparatus 100 employs a cleaner-less system. Thus, the process cartridges 1Y, 1M, 1C, and 1K for this image forming apparatus are cartridges in which a charging means and developing means are integrally disposed along with an electrophotographic photoconductive drum, and which are removably mountable in the main assembly (which hereinafter will be referred to as apparatus main assembly 100) of the image forming apparatus 100.

In each of the process cartridges 1Y, 1M, 1C, and 1B, a charging means and a developing means are integrally disposed around the peripheral surface of the photoconductive drum 2. These process cartridges 1 are structured so that they can be removably mountable in the apparatus main assembly 100. Therefore, they can be easily removed from the image forming apparatus 100, and are to be replaced at the end of the service life of the photoconductive drum 2.

As for the method for determining whether or not the service life of the process cartridge 1 has reached its end, the rotations of the photoconductive drum 2 are counted, and as the cumulative number of the rotations exceeds a predetermined value, a user is warned that the service life of the process cartridge 1 has reached its end. Obviously, the determining method does not need to be limited to the above described one; other methods may be employed.

The photoconductive drum 2 in this embodiment is an organic photoconductive member, the inherent polarity of which is negative. More specifically, it comprises a hollow aluminum cylinder, as a base member, with a diameter of approximately 30 mm, a layer of an ordinary photoconductive substance coated on the peripheral surface of the base member, and a charge injection layer as an outermost layer coated on the photoconductive layer. It is rotationally driven at a predetermined process speed, which in this embodiment is approximately 117 mm/sec.

The charge injection layer is a coated layer of a mixture of insulating resin as binder, and micro-particles of electrically conductive substance, for example, $SnO_2$, dispersed in the binder.

Figure 4:
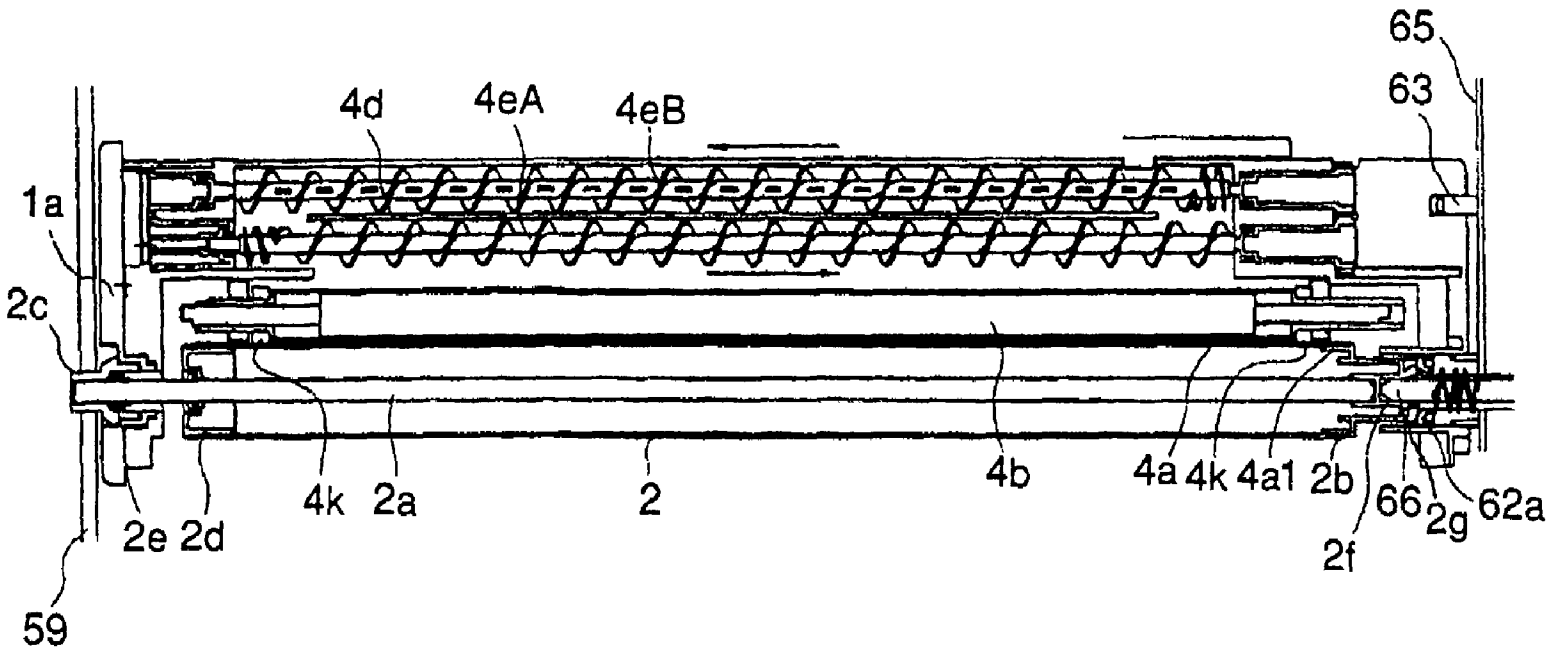
FIG. 4 is a vertical sectional view of the process cartridge in the first embodiment of the present invention, parallel to the lengthwise direction of the process cartridge.

Referring to FIG. 4, the photoconductive drum 2 is provided with a drum flange 2*b*, which is solidly attached to the back end (right end in FIG. 4) of the base drum of the photoconductive drum 2 in terms of the lengthwise direction of the photoconductive drum 2, and a drum flange 2*d*, which is solidly attached to the front end (left end in FIG. 4) of the base drum, from which the photoconductive drum 2 is not driven. The photoconductive drum 2 is also provided with a drum shaft 2*a*, which penetrates the centers of the drum flanges 2*b* and 2*d*. The drum shaft 2*a* is connected to the flange 2*d* so that it rotates with the flange 2*d*, that is, the flange on the side from which the photoconductive drum 2 is not driven, which hereinafter will be referred to as non-driven flange 2*d*. The base drum, drum shaft 2*a*, drum flange 2*b*, and non-driven flange 2*d* are rotated together. In other words, the photoconductive drum 2 is rotated about the axis of the drum shaft 2*a*.

The front end portion of the drum shaft 2*a* is rotationally supported by a bearing 2*e*, which is solidly fixed to a case 2*c*, which is solidly fixed to the frame 1*a* of the process cartridge 1.

[Charging Means]

Figure 2:
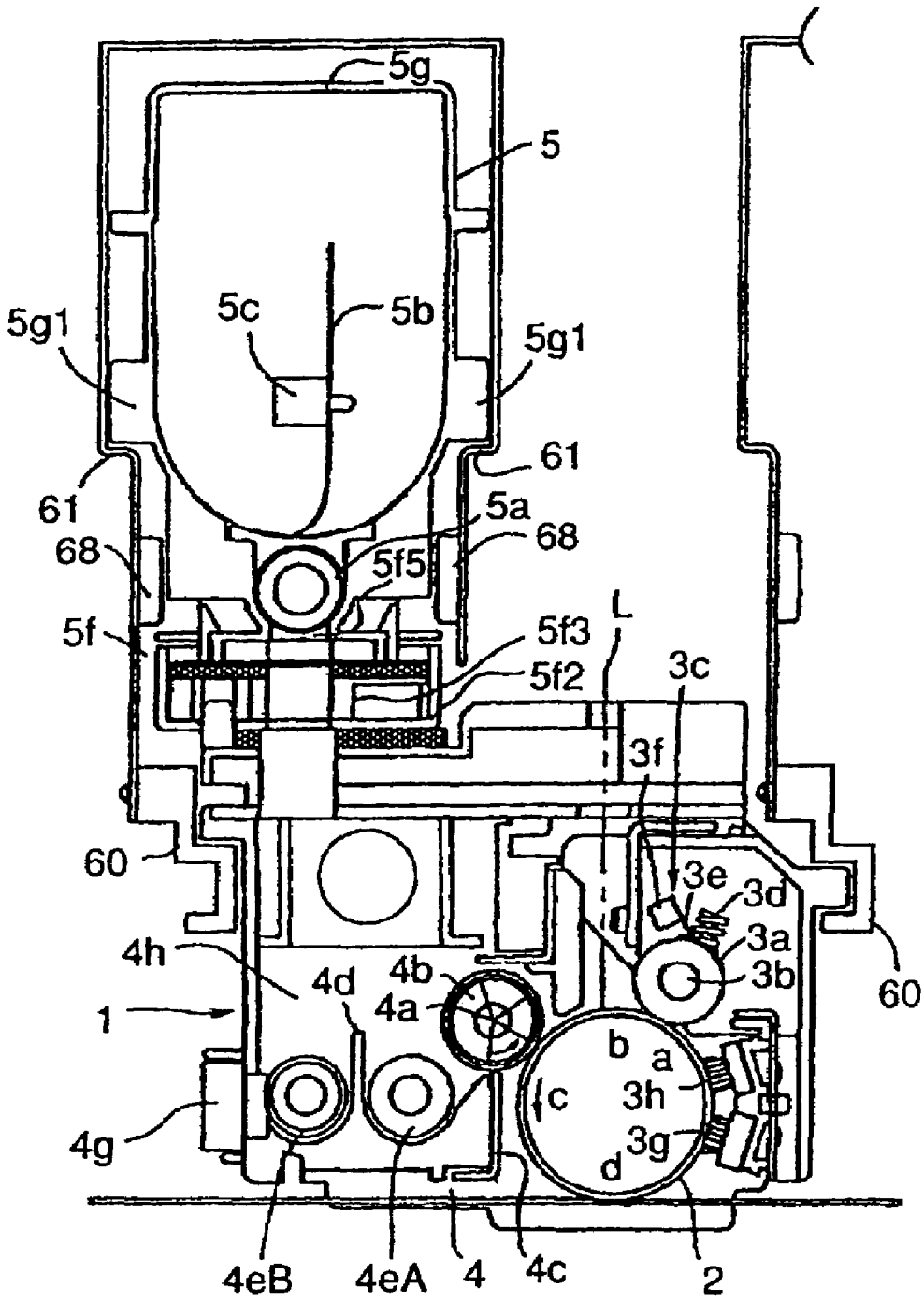
FIG. 2 is a vertical sectional view of the process cartridge and toner supply container in the first embodiment of the present invention.

Referring to FIG. 2, the charging means in this embodiment employs one of the contact type charging methods. It employs a charge roller 3*a* as a charging member. The charge roller 3*a* is rotatably supported by a pair of bearings (unshown), at the lengthwise end portions of its metallic core 3*b*. It is kept pressured toward the photoconductive drum by a pair of compression springs 3*d*; it is kept in contact with the peripheral surface of the photoconductive drum 2, so that a predetermined amount of contact pressure is maintained between the photoconductive drum 2 and the charge roller 3*a*. It is rotated by the rotation of the photoconductive drum 2.

Designated by a referential number 3*c* is a cleaning member for cleaning the charge roller 3*a*. The charge roller cleaning member 3*c* in this embodiment has a flexible cleaning film 3*e*, which extends in the lengthwise direction of the charge roller 3*a*, in parallel to the charge roller 3*a*. The cleaning film 3*e* is solidly fixed, by one of the long edges thereof, to a supporting member 3*f* which is reciprocally moved a predetermined distance in the lengthwise direction of the charge roller 3*a*. The cleaning film 3*e* is disposed so that the free long edge portion of the cleaning film 3*e* forms a contact nip against the peripheral surface of the charge roller 3*a*.

With the provision of this structural arrangement, as the supporting member 3*f* is reciprocally moved by an external driving means (unshown), the peripheral surface of the charge roller 3*a* is rubbed by the cleaning film 3*e*. As a result, the contaminants (minute particles of toner, external additive, etc.) adhering to the peripheral surface of the charge roller 3*a* are removed.

Incidentally, the image forming apparatus in this embodiment is of a cleaner-less type. Next, the cleaner-less system will be described.

[Cleaner-Less System]

Referring to FIG. 2, the outline of the cleaner-less system of the image forming apparatus in this embodiment will be described. According to the cleaner-less system in this embodiment, the transfer residual toner, that is, the toner remaining on the photoconductive drum 2 after the aforementioned toner image transfer is, generally, conveyed further by the subsequent rotation of the photoconductive drum 2 through the charging portion a and exposing portion b, and into the development portion c, in which the transfer residual toner is recovered (photoconductive drum is cleaned) by the developing means at the same time as a latent image on the photoconductive drum 2 is developed by the developing means.

Since the transfer residual toner on the peripheral surface of the photoconductive drum 2 is moved past the exposing portion b, the peripheral surface of the photoconductive drum 2 is exposed through the transfer residual toner thereon. However, the transfer residual toner is very small in quantity, not significantly affecting the exposing process.

In this embodiment, a transfer residual toner distributing means 3*g* (means for erasing residual developer image) for evenly distributing the transfer residual toner particles on the photoconductive drum 2, is disposed on the downstream side of the transfer portion d, in terms of the rotational direction of the photoconductive drum 2. Further, in order to make all the transfer residual toner particles normally charged, that is, negatively charged, a toner (developer) charge controlling means 3*h* for charging the reversely charged toner particles to negative polarity, is disposed between the downstream side of the transfer residual toner distributing means 3*g*, and the upstream side of the charging portion a, in terms of the rotational direction of the photoconductive drum 2.

With the provision of the transfer residual toner distributing means 3*g*, while the transfer residual toner particles, which are remaining, in a certain pattern, on the photoconductive drum 2, are conveyed from the transfer portion d to the toner charge controlling means 3*h*, they are evenly distributed across the peripheral surface of the photoconductive drum 2, losing therefore the pattern in which they have been adhering to the peripheral surface of the photoconductive drum 2, even if their amount is substantial. Therefore, the problem that the toner particles concentrate on certain portions of the toner charge controlling means 3*h* is eliminated, assuring thereby that the reversely charged residual toner particles are normally charged by the toner charge controlling means 3*h* so that all of the transfer residual toner particles become normal in polarity. Therefore, the adhesion of the transfer residual toner to the charge roller 3*a* is effectively prevented, and also the creation of a ghost image reflecting the pattern in which the transfer residual toner particles remain on the photoconductive drum 2 is prevented.

The transfer residual toner distributing means 3*g* and toner charge controlling means 3*h*, in this embodiment, are in the form of a brush with a proper degree of electrical conductivity, and are placed in contact with the photoconductive drum 2, with their brush portions in contact with the peripheral surface of the photoconductive drum 2.

These means 3*g* and 3*h* are structured so that they are moved (reciprocally) in the lengthwise direction of the photoconductive drum 2, by an unshown driving force source. With the provision of this structural arrangement, the transfer residual toner distributing means 3*g* and toner charge controlling means 3*h* do not remain in contact with the same ranges of the peripheral surface of the photoconductive drum 2. Therefore, it does not occur that a given portion of the peripheral surface of the photoconductive drum 2 is always contacted by the same portion of the toner charge controlling means 3*h*. Thus, even if the irregularity in electrical resistance across the toner charge controlling means 3*h* makes some portions of the toner charge controlling means 3*h* excessive in charging performance, and the other portions insufficient in charging performance, the problem that the excessively charged transfer residual toner particles adhere to certain areas of the peripheral surface of the photoconductive drum 2, and/or the problem that the insufficiently charged transfer residual toner particles adhere to certain areas of the peripheral surface of the charge roller 3*a*, are prevented or mitigated.

[Exposing Means]

In this embodiment, the aforementioned photoconductive drum 2 is exposed by a laser exposing means. More specifically, as image formation signals are sent to the exposing means from the image forming apparatus main assembly 100, a beam of laser light L is projected from the exposing means, while being modulated with the image formation signals, onto the photoconductive drum 2, in a manner to scan the uniformly charged portion of the peripheral surface of the photoconductive drum 2, selectively exposing numerous points on the uniformly charged portion of the peripheral surface of the photoconductive drum 2. As a result, an electrostatic latent image in accordance with the image formation information is formed on the peripheral surface of the photo conductive drum 2.

Referring to FIG. 1, the laser exposing means comprises: a solid laser element (unshown), a polygon mirror 51*a*, a focusing lens 51*b*, a reflection mirror 51*c*, etc. In operation, the solid laser element is turned on and off by an optical signal generating device (unshown), in response to the inputted image formation signals. The beam of laser light L irradiated from the solid laser element is converted by a collimator lens system (unshown) into a beam of virtually parallel rays, and is projected onto the polygon mirror 51*a*, which is being rotated at a high peripheral velocity. As a result, the beam of parallel rays is oscillated in a scanning manner. Then, it is further projected by way of the focusing lens 51*b* and reflection mirror 51*c*, forming an oscillating spot of light on the peripheral surface of the photoconductive drum 2.

Thus, as the spot of light oscillates, the peripheral surface of the photoconductive drum 2 is exposed in the primary scanning direction, and as the photoconductive drum 2 is rotated, it is exposed in the secondary scanning direction. As a result, numerous points on the peripheral surface of the photoconductive drum 2 are exposed or remain unexposed in such a manner that the distribution of the exposed and unexposed points reflects the image formation signal sequence. In other words, points (exposed points) with the reduced potential level, and points (unexposed points) with the normal potential level, are created, the contrast among which generates an electrostatic latent image in accordance with the image formation information.

[Developing Apparatus]

The developing apparatus 4 is of a contact type developing apparatus which uses two-component developer (two-component magnetic brush type developing apparatus). Referring to FIG. 2, the developing apparatus 4 comprises a development sleeve 4*a* as a developer bearing member, and a magnetic roller 4*b* disposed within the hollow of the development sleeve 4*a*. The development sleeve 4*a* holds a layer of developer, which is a mixture of carrier and toner, on its peripheral surface. This development sleeve 4*a* is the actual developing means. The developing apparatus 4 also comprises a regulating blade 4*c*, which is disposed in the adjacencies of the peripheral surface of the development sleeve 4*a*, with the presence of a predetermined distance from the development sleeve 4*a*. As the development sleeve 4*a* is rotated in the direction indicated by an arrow mark, a thin layer of developer is formed on the peripheral surface of the development sleeve. Incidentally, the developing apparatus 4 in this embodiment is a two-component magnetic brush type developing apparatus. However, the developing apparatus 4 does not need to be of a two-component magnetic brush type.

Referring to FIG. 4, the development sleeve 4*a* is provided with a pair of ring-shaped spacers 4*k*, which are rotatably fitted around the journal portions 4*a*1, that is, the lengthwise end portions of the development sleeve 4*a*, one for one, which are smaller in diameter than the developer carrying portion of the development sleeve 4*a*. With the provision of the spacers 4*k*, a predetermined gap is maintained between the development sleeve 4*a* and photoconductive drum 2 so that during a development operation, only the developer layer formed on the peripheral surface of the development sleeve 4*a* touches the photoconductive drum 2. Referring to FIG. 2, the development sleeve 4*a* is rotationally driven in the counterclockwise direction indicated by an arrow mark at a predetermined peripheral velocity so that, in the development portion c, the peripheral surface of the development sleeve 4*a* moves in the direction counter to the moving direction of the peripheral surface of the photoconductive drum 2.

The toner in this embodiment is such toner that is negative in inherent polarity and is 6 $\mu$m in average particle diameter. The magnetic carrier in this embodiment is 205 emu/cm$^3$ in saturation magnetization, and is 35 $\mu$m in average particle diameter. The ratio in weight between the toner and carrier in the developer is 6:94. However, the developer choice does not need to be limited to a mixture of toner and magnetic carrier. For example, magnetic toner may be used.

Referring to FIG. 2, the developer storage portion 4*h*, in which the developer is circulated, has two chambers divided by a partitioning wall 4*d* which extends in the lengthwise direction, without touching the front and back walls of the developer storage portion. The developer storage portion 4*h* has stirring screws 4*e*A and 4*e*B, which are disposed on both sides of the partitioning wall 4*d*, one for one.

Referring to FIG. 4, as the toner is supplied to the developer storage portion 4*h* from the developer supply container (developer supplying apparatus) 5, the toner falls onto the back end portion (right end portion in FIG. 4) of the stirring screw 4*e*B, and the developer supplied with the toner is conveyed frontward (left end portion in FIG. 4) of the apparatus, in terms of the lengthwise direction, while being stirred. Then, it is moved through the gap between the front wall of the developer storage portion 4*h* and the partitioning wall 4*d*, and then, is conveyed backward (rightward in FIG. 4) of the developer storage portion 4*h*, in terms of the lengthwise direction, by the stirring screw 4*e*A. Then, it is moved through the gap between the back wall of the developer storage portion 4*h* and the partitioning wall 4*d* to be conveyed again frontward. In other words, the developer is repeatedly circulated by the stirring screws 4*e*B and 4*e*A in the developer storage portion 4*h*.

At this time, referring to FIG. 2, the development process for developing an electrostatic latent image formed on the photoconductive drum 2 into a visible image with the use of the developing apparatus 4 which employs a two-component magnetic brush developing method, and the developer circulating system, will be described.

As the development sleeve 4*a* is rotated, the developer in the developer storage portion 4*h* is picked up and held to the peripheral surface of the development sleeve 4*a*, by the pickup pole of the magnetic roller 4*b*, and is conveyed further.

While being conveyed after being held to the peripheral surface of the development sleeve 4*a*, the body of developer is regulated in thickness by the development blade 4*c* disposed perpendicular to the peripheral surface of the development sleeve 4*a*. As a result, a thin layer of developer is formed on the peripheral surface of the development sleeve 4*a*. As the thin layer of developer reaches the development portion c, which corresponds in position to the development pole of the magnetic roller 4*b*, the developer layer is made to crest by the magnetic force. Thus, the electrostatic latent image on the peripheral surface of the photoconductive drum 2 is developed into a visible image, by the toner in the crest of the developer layer. Incidentally, in this embodiment, an electrostatic latent image is developed in reverse.

After being conveyed and passed through the development portion c, the thin layer of developer on the peripheral surface of the development sleeve 4*a* is made to enter the developer storage portion 4*h*, by the subsequent continual rotation of the development sleeve 4*a*. In the developer storage portion 4*h*, the developer layer is made to separate from the peripheral surface of the development sleeve 4*a*, by the repulsive magnetic field of the conveyance pole, and fall into the developer storage portion 4*h*. In other words, it is returned to the developer storage portion 4*h*.

To the development sleeve 4*a*, a combination of DC voltage and AC voltage is applied from an unshown electrical power source. In this embodiment, the combination of a DC voltage of 500 V and an AC voltage which is 2,000 Hz in frequency, and 1,500 V in peak-to-peak voltage, is applied to develop only the exposed points of the peripheral surface of the photoconductive drum 2.

Generally, in a two-component developing method, the application of AC voltage increases development efficiency, making it possible to form an image of higher quality. On the other hand, the application of AC voltage is likely to result in the formation of a foggy image. Therefore, it is a common practice to create a certain amount of difference in potential level between the potential level of the DC voltage applied to the development sleeve 4*a* and the potential level of the peripheral surface of the photoconductive drum 2 in order to prevent the formation of a foggy image. More specifically, bias voltage, the potential level of which falls between the potential level of an exposed point of the peripheral surface of the photoconductive drum 2, and the potential level of an unexposed point of the peripheral surface of the photoconductive drum 2, is applied.

As the toner is consumed by the development of an electrostatic latent image, the toner content of the developer decreases. In this embodiment, a sensor 4*g* for detecting the toner content is disposed in the adjacencies of the peripheral surface of a developer stirring screw 4*e*B, as shown in FIG. 2. As it is detected by the sensor 4*g* that the toner content of the developer has reduced below a predetermined level, a command for supplying the developer storage portion 4*h* of the developing apparatus 4 with the toner from the toner supply container 5 is issued to initiate a toner supplying operation, which maintains the toner content of the developer in the developing apparatus at a predetermined level.

[Toner Supply Container]

The toner supply containers 5Y, 5M, 5C, and 5K are disposed in parallel above the process cartridges 1Y, 1M, 1C, and 1K, respectively, and are mounted into the image forming apparatus main assembly 100 from the front side of the apparatus main assembly 100.

Referring to FIG. 2, the toner supply container 5 has a frame 5*g* as the toner storage portion (developer storage portion), in which toner, or a mixture of toner and magnetic carrier is stored. Within the frame 5*g*, a stirring plate 5*b* solidly fixed to a stirring shaft 5*c*, and a screw 5*a* (FIG. 5), are disposed.

The bottom wall of the toner supply container 5 is provided with a toner outlet 5*f* having a developer releasing hole through which the toner is discharged into a process cartridge 1.

Figure 5:
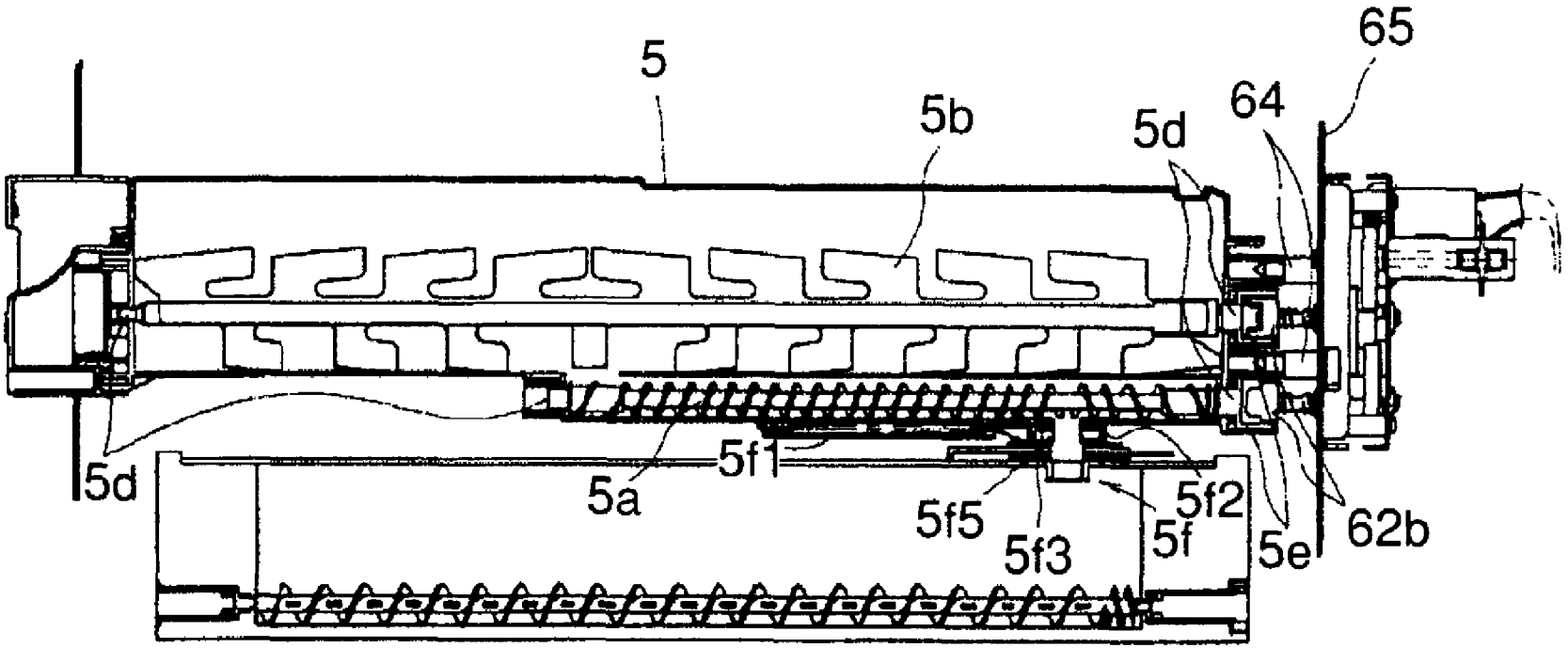
FIG. 5 is a vertical sectional view of the combination of the toner supply container and process cartridge in the first embodiment of the present invention, parallel to the lengthwise direction of the combination.

Referring to FIG. 5, the screw 5*a* and stirring shaft 5*c* are rotatably supported by bearings 5*d*, by their lengthwise ends. The screw 5*a* is provided with a driving coupling (female coupling) 5*e*, which is attached to the back end (right end in FIG. 5) of the screw 5*a*, and the stirring shaft 5*a* is also provided with a driving coupling (female coupling) 5*e*, which is attached to the back end (right end in FIG. 5). The driving couplings (female couplings) 5*e* receive the driving force transmitted through the driving couplings (male couplings) 62*b*, one for one, of the image forming apparatus main assembly 100, being thereby rotationally driven. The screw 5*a* comprises two pieces of spiral ribs located on one side of the toner outlet 5*f* and the other, and twisted in the opposite direction. The screw 5*a* is rotated in the predetermined direction by the rotation of the driving coupling 62*b*. As a result, the toner is conveyed toward the toner outlet 5*f*, and free falls through the hole 5*f*5 of the toner outlet 5*f* into the process cartridge 1; in other words, the process cartridge 1 is supplied with the toner.

The peripheral edge, that is, the outermost edge of each section of the stirring plate 5*b*, in terms of the rotational radius of the developer sending member 5*b*, is angled relative to the stirring shaft 5*c*. Thus, as each section of the stirring plate 5*b* rubs against the internal surface of the toner supply container 5, its peripheral edge portion is angled at certain degrees relative to its base portion. More specifically, the peripheral edge portion of each section of the stirring plate 5*b* is spirally twisted. Thus, as the stirring shaft 5*b* is rotated, the toner in the toner supply container 5 comes into contact with the spirally twisted edge portions of the stirring plate 5*c*, being thereby conveyed in the lengthwise direction of the stirring shaft 5*c*.

Not only can the toner supply container 5 in this embodiment supply toner to a process cartridge, or a development cartridge, which employs a two-component developing method, but also to a process cartridge or a development cartridge, which employs a single-component developing method. Further, the powder to be stored in the toner supply container does not need to be limited to toner. For example, it may be the so-called developer, that is, a mixture of toner and magnetic carrier.

[Transferring Means]

The intermediary transfer unit 54, as a transferring means, in FIG. 1 is a unit for transferring all at once onto the recording medium 52 a plurality of toner images having been sequentially transferred in layers onto the intermediary transfer unit 54 from the photoconductive drum 2.

The intermediary transferring unit 54 is provided with an intermediary transfer belt 54*a*, which runs in the direction indicated by an arrow mark at virtually the same peripheral velocity as that of the photoconductive drum 2 which rotates in the clockwise direction indicated by another arrow mark. The intermediary transfer belt 54*a* is an endless belt with a circumferential length of approximately 940 mm, and is suspended around three rollers: a driver roller 54*b*, a belt backing transfer roller 54*g* which opposes the secondary transfer roller 54*d*, and a follower roller 54*c*.

Within the loop of the intermediary transfer belt 54*a*, transfer charge rollers 54*f*Y, 54*f*M, 54*f*C, and 54*f*K are rotatably disposed, opposing the corresponding photoconductive drums 2 with the presence of the intermediary transfer belt 54*a* between the transfer charge rollers 54*f*Y, 54*f*M, 54*f*C, and 54*f*K and the corresponding photoconductive drums 2. Each transfer charge roller is kept pressured toward the center of the corresponding photoconductive drum 2.

The transfer charge rollers 54*f*Y, 54*f*M, 54*f*C, and 54*f*K are supplied with power by an unshown high voltage power source, and charge the intermediary transfer belt 54*a* to the polarity opposite to that of the toner, from the inward side of the loop of the intermediary transfer belt 54*a*, in order to sequentially transfer the toner images on the photoconductive drum 2 onto the outward surface of the intermediary transfer belt 54*a*.

During transfer, the secondary transfer roller 54*d* as a transferring member is kept pressed on the intermediary transfer belt 54*a*, opposing the belt backing transfer roller 54*g* with the presence of the intermediary transfer belt 54*a* between the secondary transfer roller 54*d* and belt backing transfer roller 54*g*. The secondary transfer roller 54*d* is movable in the vertical direction in FIG. 1, and is rotatable. Until a predetermined number of images are sequentially transferred in layers onto the intermediary transfer belt 54*a* to complete a multicolor image, the secondary transfer roller 54*d* is kept apart from the intermediary transfer belt 54*a* in order not to disturb the images on the intermediary transfer belt 54*a*.

The intermediary transfer belt 54*a* and secondary transfer roller 54*d* are individually driven. As the recording medium 52 is entered into the secondary transfer portion, a predetermined bias is applied to the secondary transfer roller 54*d*. As a result, the toner images on the intermediary transfer belt 54*a* are transferred (secondary transfer) onto the recording medium 52.

During the transfer process, the recording medium 52 is conveyed leftward in FIG. 1 at a predetermined velocity, while remaining sandwiched between the secondary transfer roller 54*d* and intermediary transfer belt 54*a*, to a fixing device 56 which carries out the next process.

The image forming apparatus main assembly 100 is provided with a cleaning unit 55, which can be placed in contact with, or moved away from, the surface of the intermediary transfer belt 54*a*, and which is at a predetermined location in the adjacencies of the downstream end of the intermediary transfer belt 54*a* in terms of the direction in which the recording medium is conveyed during the transfer process. The cleaning unit 55 removes the secondary transfer residual toner, that is, the toner remaining on the intermediary transfer belt 54*a* after the secondary transfer.

Referring again to FIG. 1, within the cleaning unit 55, a cleaning blade 55*a* for removing the transfer residual toner is disposed. The cleaning unit 55 is attached to the main assembly 100 of the image forming apparatus so that it can be pivoted about an unshown pivotal axis. The cleaning blade 55*a* is kept pressed on the intermediary transfer belt 54*a*, being tilted so that the cleaning edge of the cleaning blade 55*a* is on the upstream side relative to the base portion of the cleaning blade 55*a* in terms of the moving direction of the intermediary transfer belt 54*a*. After being taken into the cleaning unit 55, the transfer residual toner is conveyed by a screw 55*b* to a removed toner bin (unshown) and is stored therein.

[Fixing Portion]

As described above, a toner image formed on the photoconductive drum 2 by the developing means is transferred onto the recording medium 52 by way of intermediary transfer belt 54*a*. Then, the fixing device 56 thermally fixes the unfixed toner images, that is, the images having just been transferred onto the recording medium 52, to the recording medium 52.

Also referring to FIG. 1, the fixing device 56 is provided with a fixing roller 56*a* for applying heat to the recording medium 52, and a pressure roller 56*b* for pressing the recording medium 52 against the fixing roller 56*a*. Both rollers 56*a* and 56*b* are hollow. Each roller contains a heater (unshown) in its hollow. They together convey the recording medium 52 as they are rotationally driven.

In other words, while the recording medium 52, which is bearing toner images, is conveyed by the fixing roller 56*a* and pressure roller 56*b*, heat and pressure are applied to the recording medium 52 and toner images by the rollers. As a result, the toner images are fixed to the recording medium 52. After the fixation, recording medium 52 is discharged out of the image forming apparatus main assembly 100 by two pairs 53*h* and 53*j* of discharge rollers, into a delivery tray 57 on top of the image forming apparatus main assembly 100, and is accumulated therein.

[Mounting of Process Cartridge and Toner Supply Container]

Figure 3:
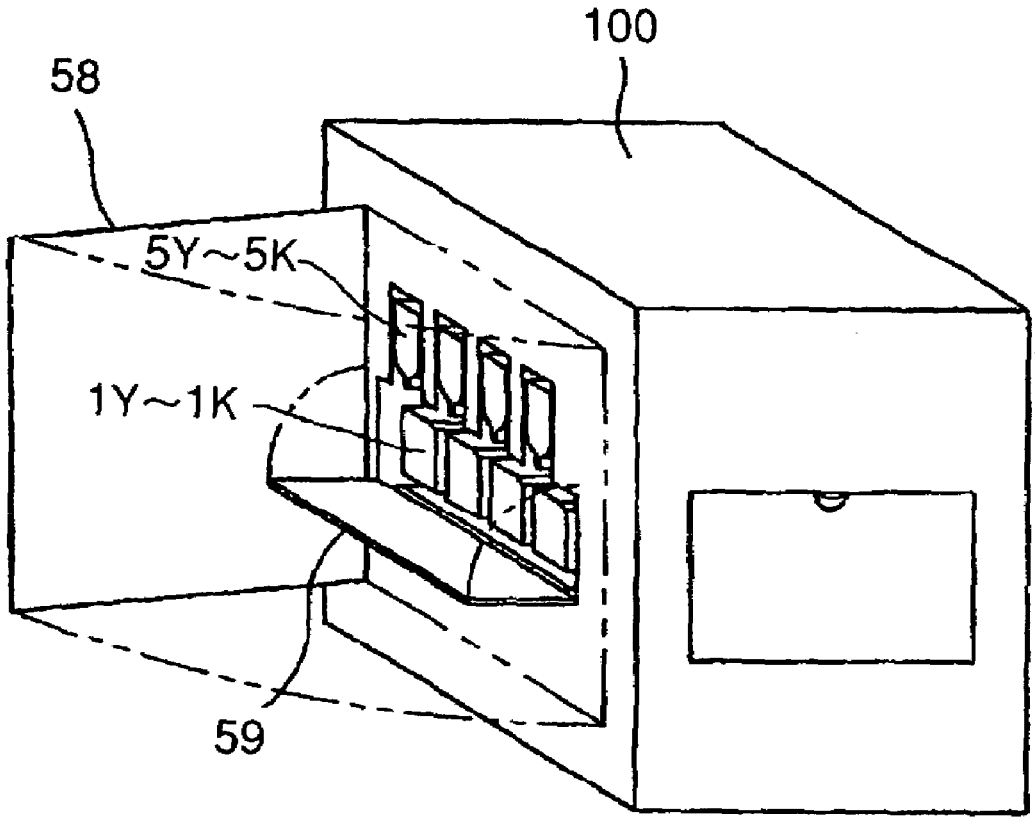
FIG. 3 is a schematic perspective view of the image forming apparatus in the first embodiment of the present invention, the front door of which is open.

Next, referring to FIGS. 2–5, the procedure for mounting the process cartridge 1 and toner supply container 5 into the image forming apparatus main assembly 100 will be described. Referring to FIG. 3, which is a schematic external perspective view of the image forming apparatus main assembly 100, the image forming apparatus main assembly 100 is provided with a front door 58, which is located in the front panel of the image forming apparatus main assembly 100 and can be freely opened or closed. As an operator opens the front door 58 frontward, the openings through which the process cartridges 1Y–1K, and toner supply containers 5Y–5K, are inserted, are exposed.

The openings through which the process cartridge 1 is inserted are provided with the drum shaft positioning plate 59, which is rotatably supported. Thus, when inserting or removing the process cartridge 1, this drum shaft positioning plate 59 must be opened. Referring to FIG. 2, in the image forming apparatus main assembly 100, four pairs of guiding rails 60 for guiding the process cartridge 1 when mounting the process cartridge 1, and four pair of guiding rails 61 for guiding the toner supply container 5 when mounting the toner supply container 5, are provided.

The directions in which the process cartridge 1 and toner supply container 5 are mounted into the image forming apparatus main assembly 100 are parallel to the axial line of the photoconductive drum 2, and so are the directions in which the guiding rails 60 and 61 extend. The process cartridge 1 and toner supply container 5 are inserted into the image forming apparatus main assembly 100, from the front side of the image forming apparatus main assembly 100, and then, are slid deeper into the image forming apparatus main assembly 100 along the guiding rails 60 and 61.

Referring to FIG. 4, as the process cartridge 1 reaches the deepest end of the image forming apparatus main assembly 100, the drum positioning shaft 66 of the image forming apparatus main assembly 100 enters the center hole 2*f* of the drum flange 2*b*. As a result, the rotational axis of the back end of the photoconductive drum 2 is accurately positioned relative to the image forming apparatus main assembly 100.

At the same time, the driving force transmitting portion 2*g* of the drum flange 2*b* engages with the driving coupling (female coupling) 62*a* of the image forming apparatus main assembly 100, making it possible for the photoconductive drum 2 to be rotationally driven. The driving force transmitting portion 2*g* in this embodiment is in the form of a twisted triangular column. Thus, as driving force is transmitted to the driving force transmitting portion 2*g* from the image forming apparatus main assembly 100, not only does the driving force transmitting portion 2*g* transmit the driving force to the photoconductive drum 2, but also generates such force that pulls the photoconductive drum 2 toward the back end of the image forming apparatus main assembly 100.

Also referring to FIG. 4, the rear wall 65 of the image forming apparatus main assembly 100 is provided with four cartridge supporting pins 63 for accurately positioning the process cartridges 1, one for one. Each cartridge supporting pin 63 enters the frame 1*a* of the inserted process cartridge 1, whereby the frame 1*a* of the process cartridge 1 is accurately fixed in its position relative to the image forming apparatus main assembly 100.

Referring again to FIG. 4, on the front side (left side in FIG. 4) of the image forming apparatus main assembly 100, the drum shaft positioning plate 59, which is rotationally opened or closed, is disposed, and with which the bearing case 2*c* of the process cartridge 1 is solidly engaged.

Through the above described process cartridge insertion sequence, the photoconductive drum 2 and process cartridge 1 are accurately positioned relative to the image forming apparatus main assembly 100.

In comparison, referring to FIG. 5, as the toner supply container 5 is inserted to the deepest end, it is solidly held by the supporting pin 64 projecting from the rear wall 65 of the image forming apparatus main assembly 100 as is the process cartridge 1 by the supporting pin 64. At the same time, the driving coupling (female) 5*e* engages with the driving coupling (male) 62*b*, making it possible to rotationally drive the screw 5*a* and stirring shaft 5*c*.

When the toner supply container 5 is mounted into the apparatus main assembly 100 in which the process cartridge is present, or when the process cartridge 1 is mounted into the apparatus main assembly 100 in which the toner supply container 5 is present, they are connected to each other by the connective portion, that is, the bottom end portion of the retaining member 5*f*2 of the toner supply container 5, at the completion of the mounting of the toner supply container 5 or the process cartridge. As a result, the toner discharged through the outlet 5*f* of the toner supply container 5 is supplied to the process cartridge 1.

All that is necessary to extract the process cartridge 1 or toner supply container 5 from the image forming apparatus main assembly 100 is to carry out the above described procedures in reverse.

In this embodiment, the process cartridge 1 and toner supply container 5 can be mounted into, or removed from, the image forming apparatus main assembly 100 in random order. In other words, it is possible to mount the toner supply container 5 into the image forming apparatus main assembly 100 after mounting the process cartridge 1 into the image forming apparatus main assembly 100, or to mount the process cartridge 1 into the image forming apparatus main assembly 100 after mounting the toner supply container 5 into the image forming apparatus main assembly 100. Further, it is possible to extract the toner supply container 5 from the image forming apparatus main assembly 100 after extracting the process cartridge 1 from the image forming apparatus main assembly 100, or to extract the process cartridge 1 from the image forming apparatus main assembly 100 after extracting the toner supply container 5 from the image forming apparatus main assembly 100.

(Embodiment 1)

Next, the toner supply container in the form of a cartridge, in the first embodiment of the present invention will be described in more detail.

Figure 6:
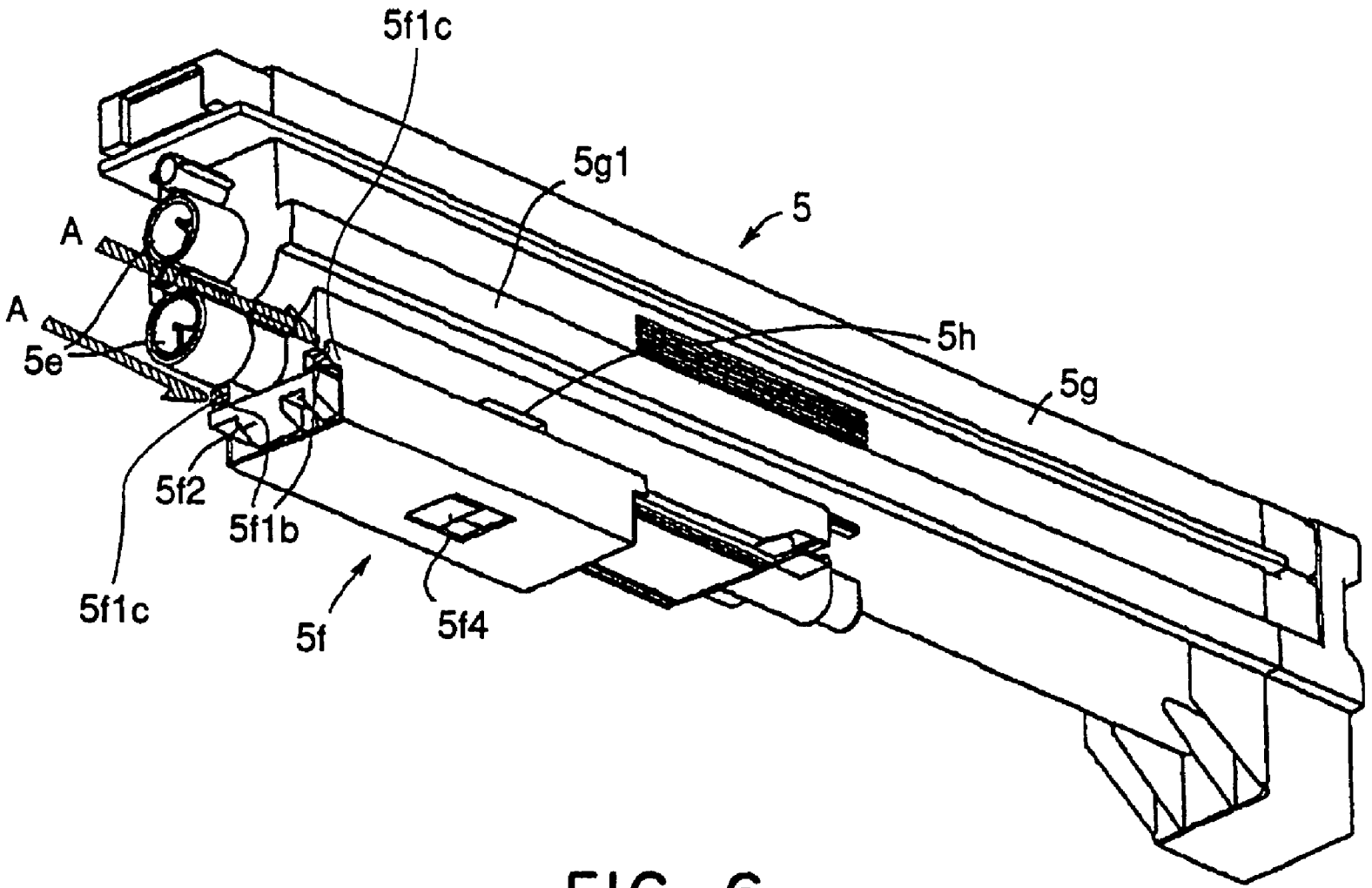
FIG. 6 is a perspective view of the toner supply container in the first embodiment of the present invention, the outlet cover of which is closed.
Figure 7:
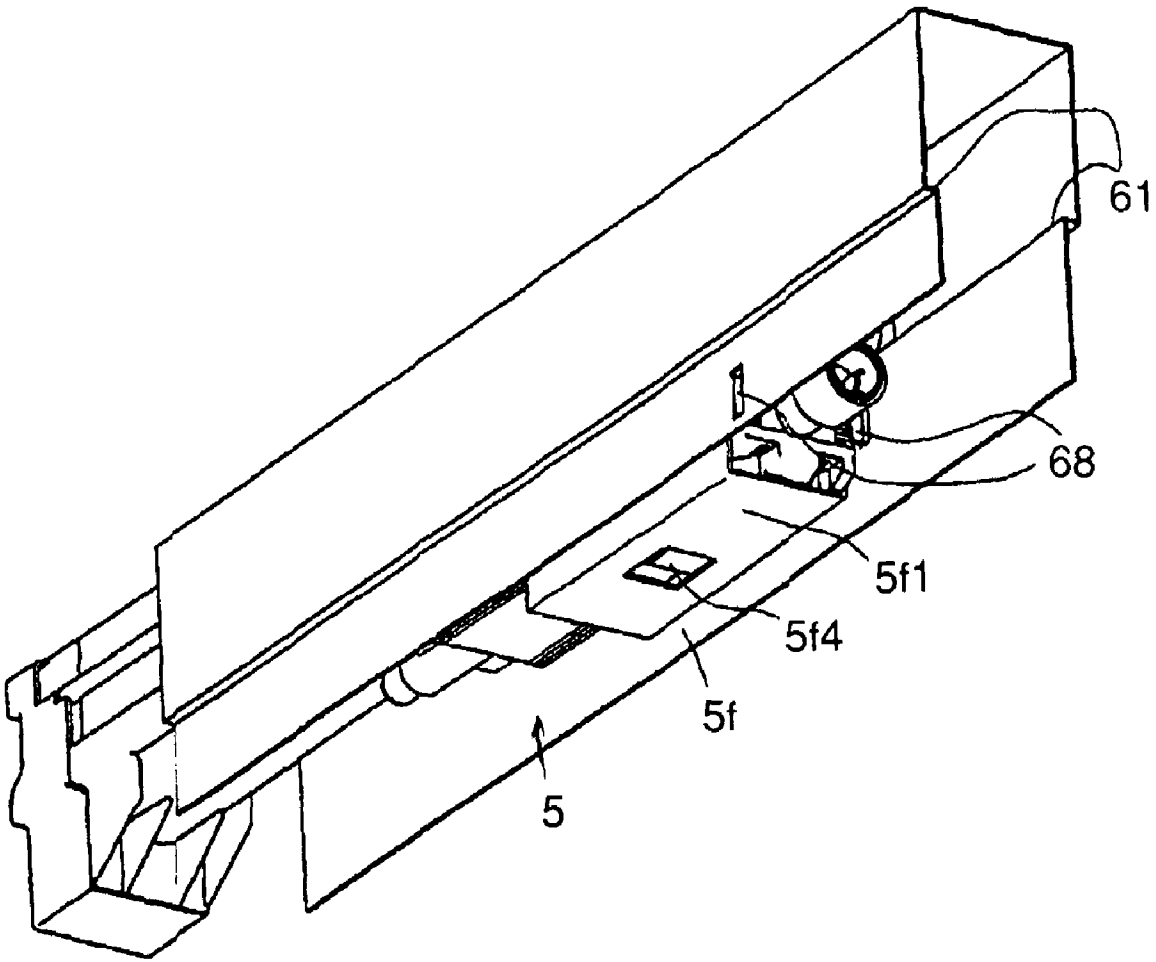
FIG. 7 is a perspective view of the toner supply container in the first embodiment of the present invention, which is being inserted into the main assembly of an image forming apparatus.

FIG. 6 is a perspective view of the toner supply container 5 in this embodiment of the present invention, as seen from below the back end thereof.

As shown in FIG. 6, the toner supply container 5 is provided with a pair of guiding portions 5*g*1, which are on the lengthwise lateral walls, one for one, of the frame 5*g* of the toner supply container 5, and which function as guides when the toner supply container 5 is inserted into the image forming apparatus main assembly 100. The toner supply container is also provided with a toner outlet 5*f*, which is attached to the bottom wall of the toner supply container 5, and a toner outlet cover 5*f*1 for covering the toner outlet 5*f*. The outlet cover 5*f*1 is provided with a pair of latching portions 5*f*1*a* and a pair of latching portions 5*f*1*b*, which engage with the pair of rails 5*h* of the toner supply container 5, allowing thereby the outlet cover 5*f*1 to move along the pair of rails 5*h*.

Prior to the mounting of the toner supply container into the apparatus main assembly 100, the outlet cover 5*f*1 is in the first position in which it covers the outlet 5*f*.

When the toner supply container 5 is inserted into the apparatus main assembly 100, the guiding portions 5*g*1 slide on the guide rails 61 of the apparatus main assembly 100, one for one, and as the toner supply container 5 is inserted, the outlet cover 5*f*1 comes into contact with a pair of projections 68 located in the adjacencies of the corresponding guide rails 61.

As the toner supply container 5 is further inserted from the point of contact, the outlet cover 5*f*1 is prevented by the projection 68 from moving forward, being pushed, in relative terms, by the projection 68. As a result, the outlet cover 5*f*1 horizontally moves relative to the main assembly of the toner supply container 5 along the rails 5*h*, until it reaches the second position in which it exposes the retaining member 5*f*2 as the connective portion between the outlet 5*f* of the toner supply container 5 and process cartridge. The portion of the outlet cover 5*f*1, by which the outlet cover 5*f*1 is pushed by the projection 68 is the contact portion 5*f*1*c* of the outlet cover 5*f*1; the toner outlet cover 5*f*1 is pushed, in relative terms, by the projection 68 in the direction indicated by an arrow marks in FIG. 6.

Figure 8:
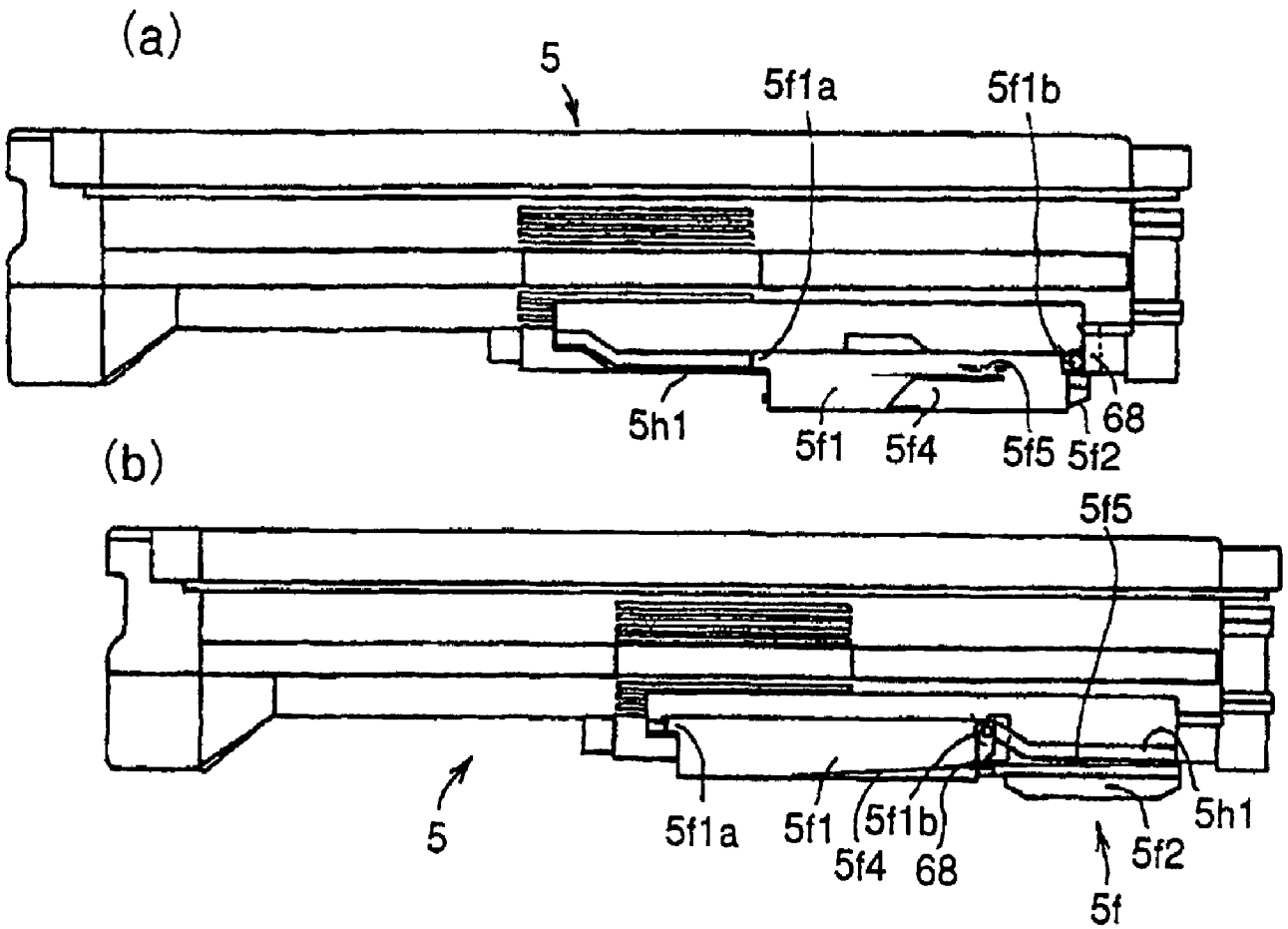
FIGS. 8(*a*) and 8(*b*) are drawings for showing the movements of the outlet cover during the insertion of the toner supply container into the main assembly of an image forming apparatus.
Figure 9:
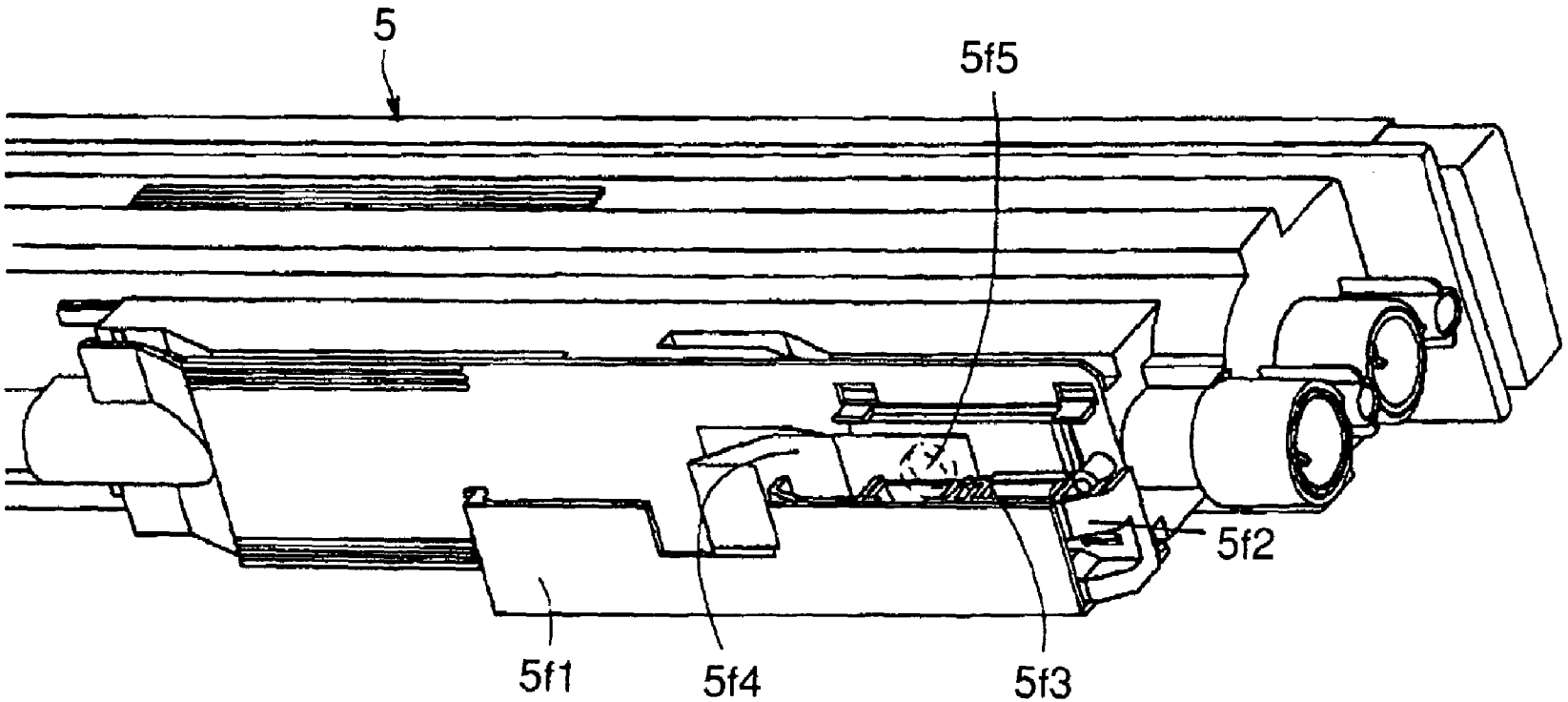
FIG. 9 is an enlarged perspective view of the outlet portion of the toner supply container, and its adjacencies, in the first embodiment of the present invention, with the outlet cover being closed.

FIGS. 8(*a*) and 8(*b*) are drawings for describing in detail the movement of the outlet cover 5*f*1. In this drawing, the position of outlet cover 5*f*1 at the beginning of the mounting of the toner supply container 5 into the apparatus main assembly 100, and the position of the outlet cover 5*f*1 at the end thereof, are shown by the top and bottom sides, respectively, of the drawings. FIG. 9 is an enlarged view of the outlet portion 5*f* at the beginning of the mounting. In the drawing, the right halves of the toner outlet cover 5*f*1, the retaining member 5*f*2, and the toner outlet shutter 5*f*3, as seen from the trailing side thereof, in terms of the toner supply cartridge insertion direction, have been removed for the ease of visual confirmation.

Referring to FIG. 9, the hole 5*f*5 of the toner outlet 5*f* is sealed with the tape 5*f*4, which is folded back at a point in the adjacencies of the hole 5*f*5, is doubled back past the hole 5*f*5, and is fixed to the outlet cover 5*f*1.

Referring to FIGS. 8(*a*) and 8(*b*), prior to the beginning of the mounting of the toner supply container 5 into the apparatus main assembly 100, the hole 5*f*5 has been sealed with the tape 5*f*4. However, as the toner supply container 5 is inserted into the apparatus main assembly 100, the outlet cover 5*f*1 is moved relative to the main assembly of the toner supply container 5, while dragging the tape 5*f*4 fixed to the outlet cover 5*f*1 by one end. Therefore, by the time the mounting of the toner supply container 5 into the apparatus main assembly 100 ends, the hole 5*f*5 will have been completely exposed.

Figure 10:
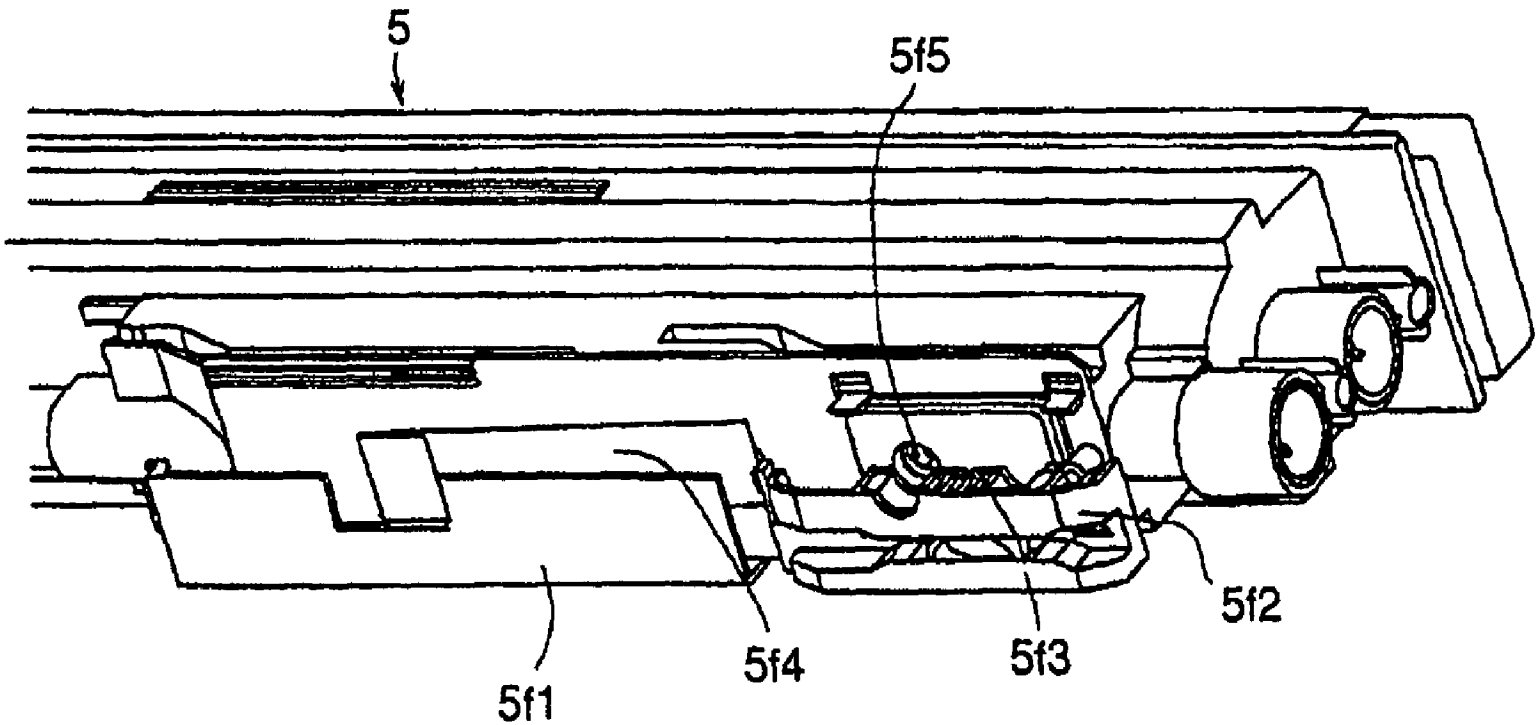
FIG. 10 is an enlarged perspective view of the outlet portion of the toner supply container, and its adjacencies, in the first embodiment of the present invention, with the outlet cover being open.

FIG. 10 is an enlarged view of the toner outlet 5*f* at the end of the mounting of the toner supply container 5 into the apparatus main assembly 100. Also in this drawing, the right halves of the toner outlet cover 5*f*1, retaining member 5*f*2, and toner outlet shutter 5*f*3, as seen from the trailing side thereof, in terms of the toner supply cartridge insertion direction, have been removed for the ease of visual confirmation.

It must be assured that the outlet cover 5*f*1 will not dislodge during the period from the completion of the manufacture of the toner supply container 5 until a user actually mounts the toner supply container 5 into the apparatus main assembly 100. However, the toner supply container 5 is subjected to various shocks during the period from the completion of the manufacture of the toner supply container 5 until a user uses the toner supply container 5 for the very first time, during the shipment of the toner supply container 5, or during the like period. Thus, there is a concern that unless the outlet cover **5*f*1 is secured with some kind of means so that it will not easily move, the tape 5*f*4 will be peeled by the movement of the outlet cover 5*f*1**, allowing thereby the developer to leak.

Thus, in this embodiment, the toner supply container 5 is structured so that until it is mounted into the apparatus main assembly 100, the outlet cover **5*f*1** will not easily move.

Figure 11:
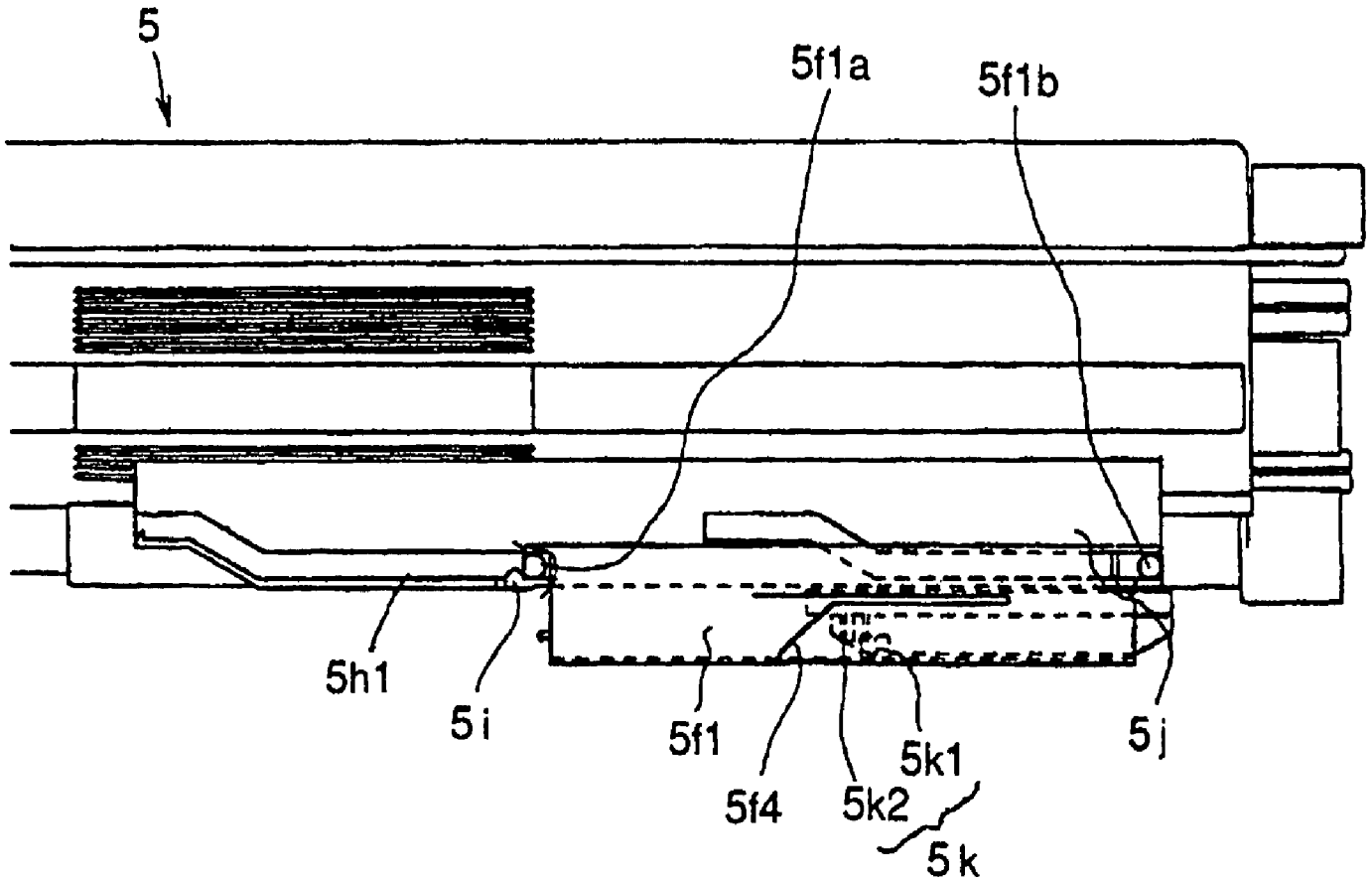
FIG. 11 is an enlarged side view of the outlet cover of the toner supply container, and the means for retaining the outlet cover in place, in the first embodiment of the present invention.

FIG. 11 is an enlarged side view of the toner outlet cover **5*f*1, and its adjacencies, of the toner supply container 5, as seen from the direction perpendicular to the lengthwise direction of the toner supply container 5**.

As will be evident from the drawing, the outlet cover **5*f*1 is locked in place by latch portions 5*i*, 5*j*, and 5*k***.

Next, referring to FIGS. 12–14, the latch portions **5*i*, 5*j*, and 5*k*** will be described.

Figure 12:
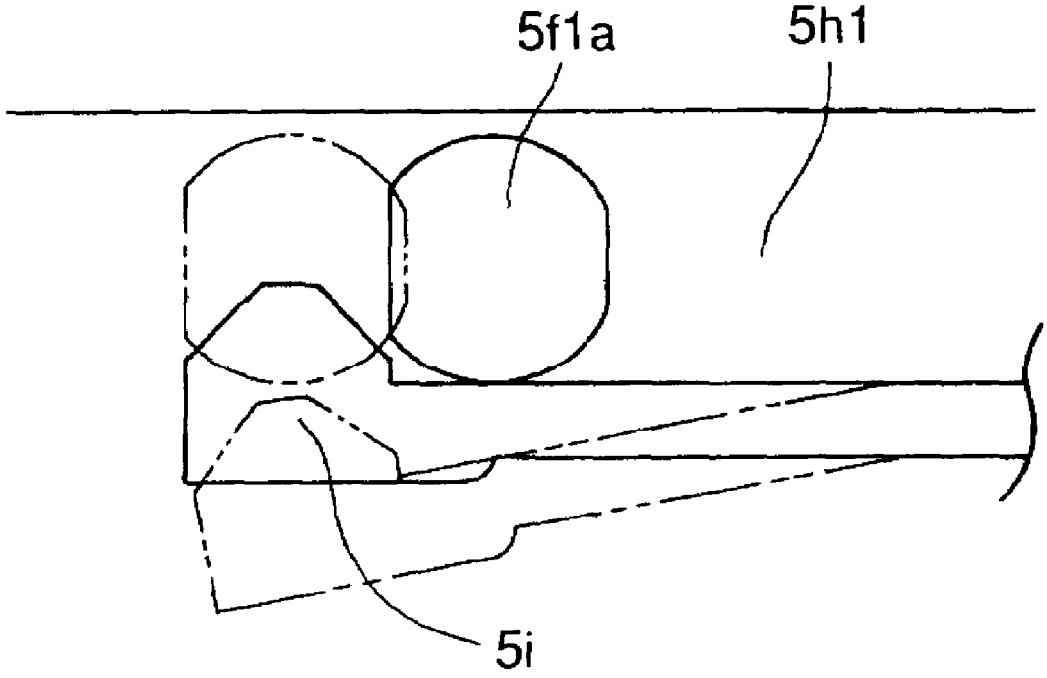
FIG. 12 is an enlarged view of the first portion of the outlet cover retaining means, in the first embodiment of the present invention.

FIG. 12 is an enlarged view of the first latch portion **5*i* of the outlet cover retaining means, and the corresponding catch portion 5*f*1*a* of the section 5*f*1 of the rail 5*h***.

As will be evident from the drawing, the firs latch portion **5*i* engages with the catch portion 5*f*1*a* of the section 5*h*1 of the rail 5*h***.

In this embodiment, the frame **5*g* is molded of resin, and the first latch portion 5*i* is an integral part of the frame 5*g*. Thus, the first latch portion 5*i*** is allowed to elastically flex as contoured by the double-dot chain line in the drawing.

Referring to FIG. 12, the front and back surface of the head portion of the first latch portion **5*i*, in terms of the toner supply container insertion direction, are angled rearward and frontward, respectively, making the head portion tapered. Therefore, when the toner supply container 5 is inserted or extracted, the first latch portion 5*f*1*a* of the outlet cover 5*f*1 comes into contact with the front or back surface of the catch portion 5*f*1*a* of the section 5*h*1 of the rail 5*h*, causing thereby the first latch portion 5*i* to elastically flex to allow the latch portion 5*i* to ride over the catch portion 5*f*1*a***.

Obviously, a certain amount of force is necessary to elastically flex the first latch portion **5*i* of the toner supply container 5, as contoured by the double-dot chain line, to allow the first latch portion 5*i* to ride over the catch portion 5*f*1*a*. This force necessary to elastically flex the first latch portion 5*i* equals the latent force F1 which keeps the outlet cover 5*f*1 retained in place at the catch portion 5*f*1*a*. In other words, the latent force F1 capable of retaining the outlet cover 5*f*1 in place equals the amount of the resiliency of the flexible latch portion 5*i***.

Figure 13:
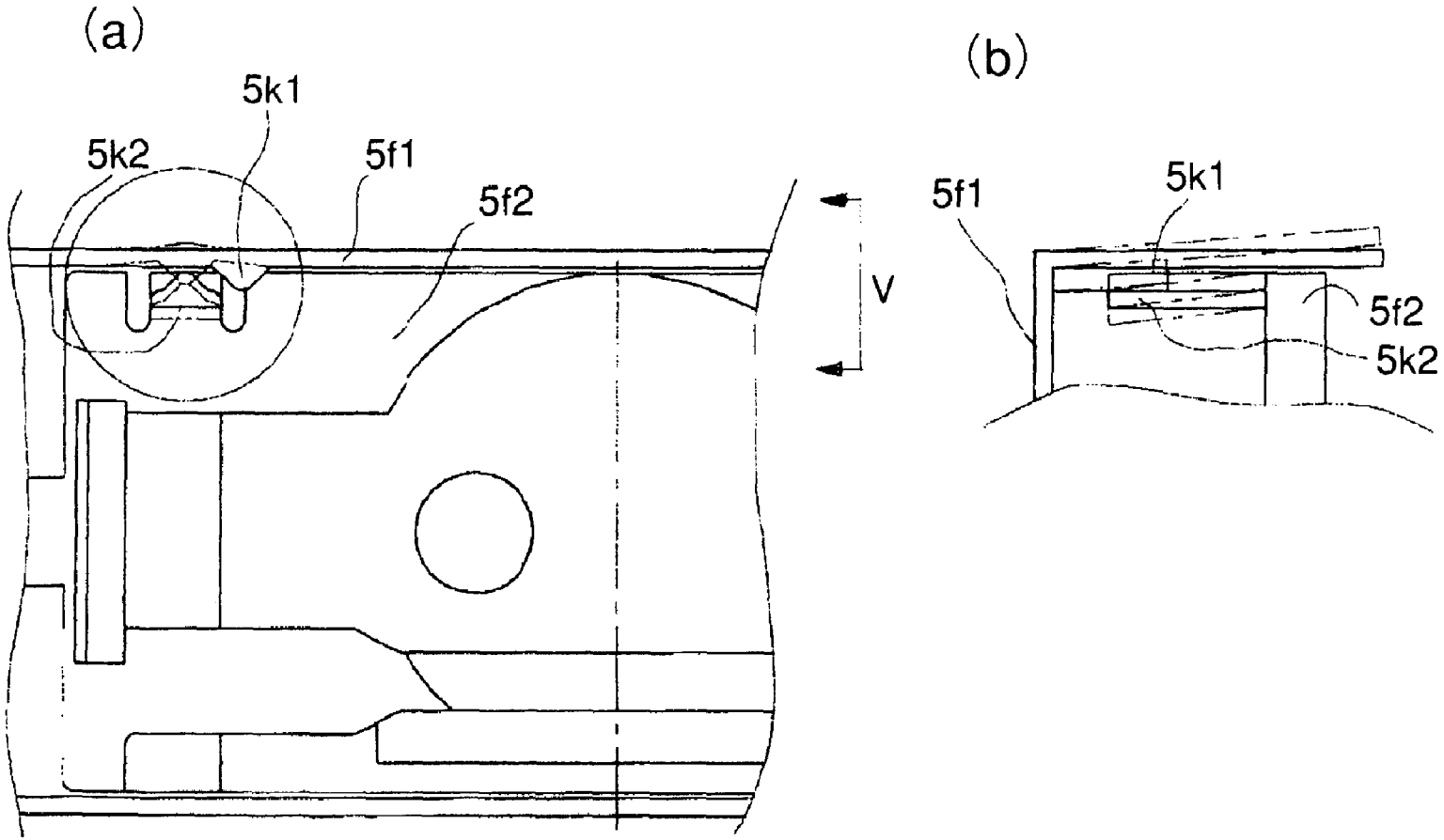
FIG. 13 is an enlarged view of the second portion of the outlet cover retaining means, in the first embodiment of the present invention, FIG. 13(A) being the view seen from below (right side) thereof, and FIG. 13(B) being the view of the circled area in FIG. 11(A) seen from the direction indicated by an arrow mark V.

FIG. 13 is an enlarged view of the second portion **5*k* of the toner supply container 5, for retaining the outlet cover 5*f*1 in place. In the drawing, the top half is a plan view as seen from above, and the bottom half is a side view as seen from the direction perpendicular to the lengthwise direction of the toner supply container 5**.

As is evident from the drawing, the latch portion **5*k*1 of the outlet cover 5*f*1 is engaged with the catch portion 5*k*2 of the connective portion of the retaining member 5*f*2, and the outlet cover 5*f*1** is in the first position.

The outlet cover **5*f*1 and the connective portion of the retaining member 5*f*2 are molded of resin, and the latch portion 5*k*1 and catch portion 5*k*2** thereof, respectively, are structured so that they are allowed to elastically flex.

Both the latch portion **5*k*1 and catch portion 5*k*2 are tapered so that they reduce in width toward their tips; their front and back surfaces, in terms of the toner supply container insertion direction, are slanted backward and frontward, respectively. Therefore, whether it is when the toner supply container 5 is inserted into, or extracted from, the apparatus main assembly 100, the latch portion 5*k*1 and catch portion 5*k*2** both elastically flex.

With the provision of this structural arrangement, the latch proper **5*k*1 of the second toner supply container retaining portion 5*k* is kept engaged with the catch portion 5*k*2 of the second toner supply container retaining portion 5*k*, by a force F2, which equals the reactive force which the combination of the latch proper 5*k*1 and catch portion 5*k*2** are capable of generating by their elasticity.

Figure 14:
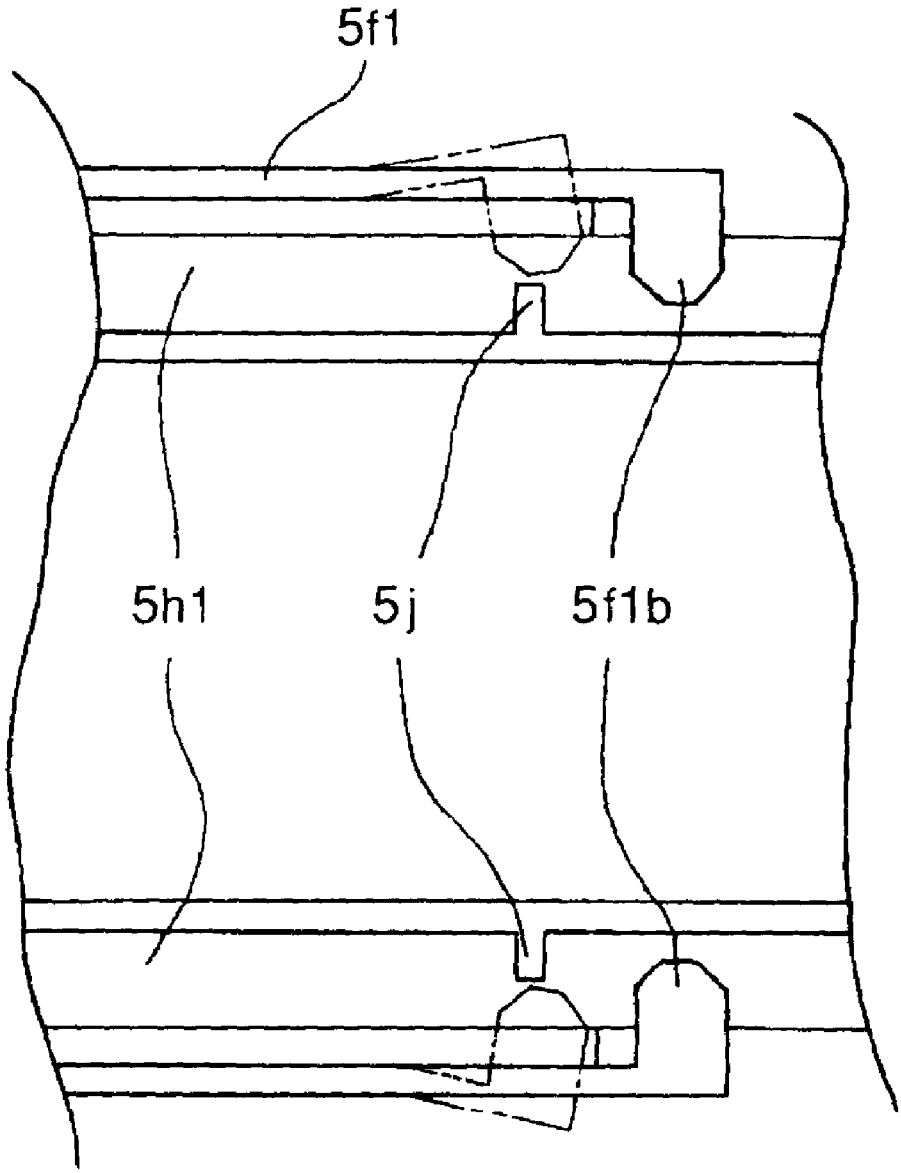
FIG. 14 is an enlarged view of the third portion of the outlet cover retaining means, in the first embodiment of the present invention.

FIG. 14 is an enlarged view of the third portion **5*j* of the toner supply container 5, for retaining the outlet cover 5*f*1** in place.

As is evident from the drawing, as the movement of the outlet cover **5*f*1 relative to the main assembly of the toner supply container 5 in terms of the lengthwise direction of the toner supply container 5 is checked by the contact between the latch portion 5*f*1*b* of the outlet cover 5*f*1 engaged with the section 5*h*1 of the rail 5*h*, and the catch portion 5*j* of the third portion for retaining the outlet cover 5*f*1 in place. The front and back sides of the end portion of the latch portion 5*f*1*b* of the outlet cover 5*f*1, in terms of the toner supply container insertion direction, are slanted backward and forward, respectively. Therefore, whether it is when the toner supply container 5 is inserted into, or extracted from, the apparatus main assembly 100, these slanted surfaces come into contact with the catch portion 5*j* of the third portion for retaining the outlet cover 5*f*1 in place, causing the latch portion 5*f*1*b*** to elastically flex.

As will be evident from the above description, a latent force F3 which keeps the outlet cover **5*f*1 virtually locked in place comes from the elasticity of the elastically flexible latch portion 5*f*1*b***.

In other words, as the means for checking the movement of the outlet cover **5*f*1 in the toner supply container insertion direction, one or both of the outlet cover 5*f*1 and the main assembly of the toner supply container 5 are provided with an elastically flexible hook, latch, catch, or the like, so that the movement of the outlet cover 5*f*1 is checked by the contact between the elastically flexible portions of the outlet cover 5*f*1 and the elastically flexible portions of the main assembly of the toner supply container 5**.

The weight of the outlet cover **5*f*1 in this embodiment is approximately 15 g–20 g. According to the studies made by the inventors of the present invention, the amount of the impact $F_0$ to which the outlet cover 5*f*1** is subjected during shipment is roughly 24.5 N.

Therefore, it is reasonable to think that as long as the total latent (reactive) force F which can be generated by the elasticity of the toner outlet cover retaining (securing) means in this embodiment is greater than 24.5N, in other words, as long as $F=F1+F2+F3>24.5$ N, the shocks to which the outlet cover **5*f*1 is subjected do not move the outlet cover 5*f*1 from the first position to the second position. It should be noted here that the latent force F is the amount of force necessary to be applied to the contact portion 5*f*1*c* of the outlet cover 5*f*1 in the direction indicated by an arrow mark A, in order to move the outlet cover 5*f*1** from the first position to the second position.

It has been known through the studies made by the inventors of the present invention that as long as the latent force F (which hereinafter will be referred to as retentive force F) satisfies the following inequity: $F<68.6$ N, there is no problem as far as the operability of the toner supply container 5 is concerned.

Therefore, all that is necessary is for the retentive force F to satisfy the following inequity: $24.5\ N<F<68.6$ N. In this embodiment, the toner supply container 5 is designed so that the total of the retentive forces from the latch portions 5*i*, 5*j*, and 5*k* falls within a range of 29.4 N–58.8 N.

Incidentally, in this embodiment, the means for retaining the outlet cover in place (which hereinafter will be referred to as retentive means) is made up of a plurality of portions for retaining the outlet cover in place (which hereinafter will be referred to as retentive portions). However, the retentive means may be made up of a single retentive portion as long as it satisfies the above described requirements regarding the correlation between the amount of the shock and the amount of the retentive force, and the correlation between the amount of retentive force and the operability of the toner supply container 5.

The reason why the retentive means in this embodiment is made up of the plurality of retentive portions is as follows:

First, it is for reducing the size of the retentive means by replacing a single large retentive portion with a plurality of small retentive portions, because it is possible to provide a greater amount of retentive force by the employment of a plurality of small retentive portion, instead of a single large retentive portion. In other words, it is possible to provide the force necessary for outlet cover retention, without relying on a single large retentive portion.

Another reason is the so-called malfunction countermeasure. In other words, with the provision of the plurality of retentive portions, even if one of the retentive portions fails, the rest of the retentive portions make it possible for the toner supply container 5 to withstand a certain amount of shock.

As described above, the toner supply container 5 in this embodiment is provided with three retentive portions different in location, on each side. More specifically, three retentive portions (latch portions and catch portions) 5*i*, 5*j*, and 5*k* are disposed, on each side, on the hypothetical lines extended approximately in the direction indicated by arrow marks A in FIG. 6 from the points by which the outlet cover 5*f*1 is pushed by the projections 68.

With the above described placement of the retentive portions, the outlet cover 5*f*1 can be freed and slid without chattering.

More specifically, as the outlet cover 5*f*1 is pushed by the contact points 5*f*1*c*, a reactive force is generated at each of the retentive portions. Thus, it is reasonable to think that as long as the requirements for preventing the sum of the reactive forces generated at the retentive portions, from generating moment in the outlet cover 5*f*1, is satisfied, the outlet cover 5*f*1 will not chatter or rattle. In this embodiment, the toner supply container 5 is structured so that all of these requirements are satisfied for all practical purposes.

This embodiment of the present invention relates to the means for retaining in place the covering member of a toner supply containers. However, the above described structural arrangement for a toner supply container is also applicable to a process cartridge, which is obvious.

(Embodiment 2)

Figure 15:
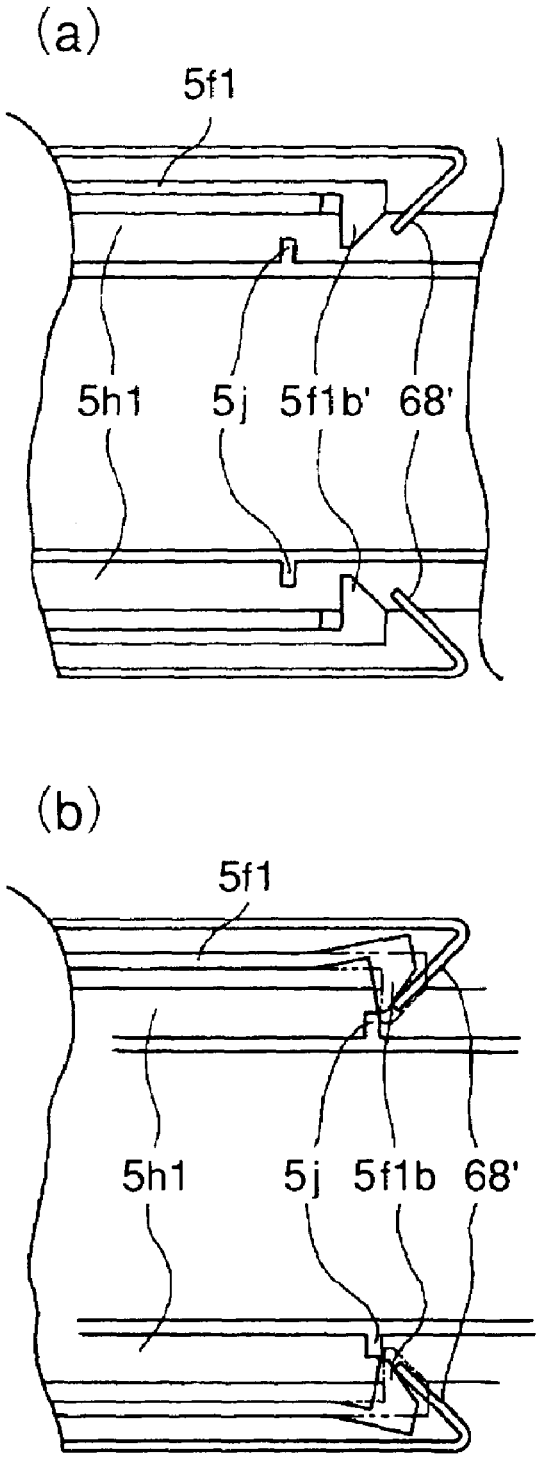
FIG. 15 is an enlarged view of the means for retaining the outlet cover in place, in the second embodiment of the present invention.

Shown in FIG. 15 is the second embodiment of the present invention. In this embodiment, the main assembly of an image forming apparatus is provided with a means for disengaging the outlet cover retaining means. More specifically, the toner supply container in this embodiment is structured so that the latch portion 5*f*1*b*' of the outlet cover 5*f*1 is disengaged from the third catch portion 5*j* by a disengaging means on the apparatus main assembly side.

Otherwise, the toner supply container in this embodiment is structured as is the toner supply container in the first embodiment. Thus, the structural arrangement other than the means for disengaging the latch portion 5*f*1*b*' from the third catch portion 5*j* will not be described.

FIG. 15 is an enlarged view of the outlet cover retaining means, and its adjacencies, in the second embodiment of the present invention.

This drawing shows the movements of the outlet cover 5*f*1 and the retentive portion therefor, which occur with the progression of the insertion of the toner supply container 5 into the apparatus main assembly 100. With the progression of the insertion, the states of the outlet cover 5*f*1 and the retentive portion therefor change from the state shown in FIG. 15(*a*) to that in FIG. 15(*b*).

This embodiment is different from the above described first embodiment in that in this embodiment, the head portion of the latch portion 5*f*1*b*' of the outlet cover 5*f*1 is given a slanted surface only on one side (side toward which toner supply container 5 is extracted from apparatus main assembly).

The opposing side of the latch portion 5*f*1*b*' is given a surface perpendicular to the direction in which the toner supply container 5 is inserted into the apparatus main assembly. In addition, the surface of the third catch portion 5*j*, with which the latch portion 5*f*1*b*' engages, is made perpendicular to the toner supply container insertion direction.

Therefore, as far as the relationship between the latch portion 5*f*1*b*' and third latch portion 5*j* is concerned, once the latch portion 5*f*1*b*' engages with third latch portion 5*j*, the application of additional force does not result in the bending of the latch portion 5*f*1*b*', because the engagement between the latch portion 5*f*1*b*' and third latch portion 5*j* occurs by their surfaces perpendicular to the toner supply container insertion direction. In other words, the application of the additional force does not result in the disengagement between the latch portion 5*f*1*b*' and third latch portion 5*j*. Of course, application of an extremely large force will result in the destruction of one of the two retentive portions, which results in the disengagement. In this embodiment, however, such an extraordinary situation has not been taken into consideration.

Also in this embodiment, the projection 68' of the apparatus main assembly is tilted at an angle which matches the angle of the slanted surface of the latch portion 5*f*1*b*'.

With the provision of this structural arrangement, as the toner supply container 5 is inserted into the apparatus main assembly, the slanted surface of the latch portion 5*f*1*b*' comes into contact with the slanted surface of the projection 68'. Then, as the toner supply container 5 is inserted deeper, the latch portion 5*f*1*b*' moves with the outlet cover 5*f*1, and comes into contact with the third latch portion 5*j*.

Then, as the toner supply container 5 is inserted more deeply, the latch portion 5*f*1*b*' slides onto the projection 68', with the slanted surface of the latch portion 5*f*1*b*' remaining in contact with the slanted surface of the projection 68'. As a result, the latch portion 5*f*1*b*' is bent in the direction to move away from the third catch portion 5*j* as shown in FIG. 15(*b*), being thereby allowed to move over the third catch portion 5*j*; in other words, the outlet cover 5*f*1 is released. As is evident from the above description, not only does the projection 68' in this embodiment have the function of pushing the outlet cover 5*f*1, but also it plays the role of an outlet cover releasing means which disengages the latch portion 5*f*1*b*' from the catch portion 5*j*.

As described above, in this embodiment, the outlet cover 5*f*1 is not released from its first position unless it is released from the first position by the projection 68', as the outlet cover releasing means, of the apparatus main assembly. With the employment of this structural arrangement, not only is it possible to prevent the sealing tape 5f4 from being accidentally peeled by the shocks or the like which occur during shipment, but also it is possible to prevent the sealing tape 5f4 from being accidentally peeled while the toner supply container 5 is assembled or packaged.

Next, the above descriptions of the embodiments of the present invention will be summarized, and also, will be supplemented as necessary.

The toner supply container 5, in the form of a cartridge, in accordance with the present invention, which comprises:

the frame 5g as a developer storage portion for holding developer (toner, or mixture of toner and magnetic carrier);

the outlet 5f5 as a portion through which the developer in the frame 5g is discharged; and the piece of tape 5f4 as a sealing member which is for keeping the outlet 5f5 sealed until the toner supply container 5 is used for the very first time, and is peelable to expose the hole of the outlet 5f5 when the toner supply container 5 is used for the first time; and which is removably mountable in the main assembly of an image forming apparatus;

is characterized in that the toner supply container 5 further comprises:

the outlet cover 5f1 as a cartridge cover, to which one end of the tape 5f4 is fixed, so that, as the outlet cover 5f1 is moved from the position in which it covers the hole of the outlet 5f5 to the position in which it exposes the hole of the outlet 5f5, by the mounting of the toner supply container 5 into the image forming apparatus main assembly, the outlet cover 5f1 peels the tape 5f4; and the outlet cover retaining means (retentive portions 5k, 5j, and 5k) for retaining the outlet cover 5f1 in the position (first position) in which the outlet cover 5f1 covers the hole of the outlet 5f5.

With the provision of the above described structural arrangement, the tape 5f4 can be peeled by the operation for mounting the toner supply container 5 into the image forming apparatus main assembly. In other words, the mounting of the toner supply container 5 and peeling of the tape 5f4 can be accomplished by a single operation, improving thereby operational efficiency, and also, preventing the problem that a user mounts the toner supply container 5 into the image forming apparatus main assembly without remembering to peel the tape 5f4.

Further, with the provision of the outlet cover retaining means, it is possible to prevent the outlet cover 5f1 from easily dislodging. Therefore, it is possible to prevent the tape 5f4 from being peeled before the toner supply container 5 is used for the very first time. Therefore, it is possible to prevent the developer in the toner supply container 5 from leaking before the toner supply container 5 is used for the very first time.

The outlet cover retaining means is desired to be an elastic outlet cover retaining means which utilizes its elasticity to retain the outlet cover 5f1 in place.

The outlet cover retaining means is desired to have a plurality of retentive portions different in location.

With this configuration, not only is it possible to reduce in size the structural components of the outlet cover retaining means, but also, a certain amount of retentive force (capacity) remains, even if one of the retentive portions happens to break.

The retentive force by the outlet retaining means is desired to be in the range of 29.4 N–58.8 N.

With the retentive force being in the above described range, it is possible to easily satisfy the requirement that the retentive force is desired to be no less than the theoretical shock of 24.5 N to which the toner supply container 5 might be subjected during shipment or the like, and the requirement that, for the sake of operability, the retentive force is desired to be no more than 68.6 N.

Further, the image forming apparatuses in the preceding embodiments of the present invention, in which the toner supply container 5, in the form of a cartridge, is removably mountable, and which is for forming an image on recording medium (paper or the like), is characterized in that it comprises:

the mounting mechanism (essentially, guide rails 61) for removably mounting the toner supply container 5 removably mountable in the main assembly of an image forming apparatus and comprising: the frame 5g as a developer storage portion for holding developer (toner, or mixture of toner and magnetic carrier); the outlet 5f5 as a portion through which the developer in the frame 5g is discharged; the piece of tape 5f4 as a sealing member which is for keeping the outlet 5f5 sealed until the toner supply container 5 is used for the very first time, and is peelable to expose the hole of the outlet 5f5 when the toner supply container 5 is used for the first time; and the outlet cover 5f1 as a cartridge cover, to which one end of the tape 5f4 is fixed, so that, as the outlet cover 5f1 is moved from the position, in which it covers the hole of the outlet 5f5, to the position in which it exposes the hole of the outlet 5f5, by the mounting of the toner supply container 5 into the image forming apparatus main assembly, it peels the tape 5f4; and the outlet cover retaining means (retentive portions 5k, 5j, and 5k) for retaining the outlet cover 5f1 in the position (first position) in which the outlet cover 5f1 covers the hole of the outlet 5f5.

With the provision of this structural arrangement, the tape 5f4 can be peeled by the operation for mounting the toner supply container 5 into the image forming apparatus main assembly. In other words, the mounting of the toner supply container 5 and peeling of the tape 5f4 can be accomplished by a single operation, improving thereby operational efficiency, and also, preventing the problem that a user mounts the toner supply container 5 into the image forming apparatus main assembly without remembering to peel the tape 5f4.

Further, with the provision of the outlet cover retaining means, it is possible to prevent the outlet cover 5f1 from easily dislodging. Therefore, it is possible to prevent the tape 5f4 from being peeled before the toner supply container 5 is used for the very first time. Therefore, it is possible to prevent the developer in the toner supply container 5 from leaking before the toner supply container 5 is used for the very first time.

It is desired that the image forming apparatus main assembly is provided with the projection 68' as an outlet cover releasing means, which is made to disengage the outlet cover retaining means, by the operation for mounting the toner supply container 5 into the image forming apparatus main assembly.

With the provision of this structural arrangement, not only is it possible to prevent the sealing tape from being accidentally peeled by the shocks or the like which occur during shipment, but also it is possible to prevent the sealing tape from being accidentally peeled while the toner supply container 5 is assembled or packaged.

As described above, with the provision of the structural arrangements in the preceding embodiments of the present invention, it is possible to simplify the operation for peeling the sealing tape when a cartridge is used for the very first time, while preventing the sealing tape from being easily peeled before the cartridge is used for the very first time.

As will be evident from the above descriptions of the embodiments of the present invention, the present invention makes it easy to remove the sealing tape from a cartridge before the cartridge is used for the very first time. It also prevents the sealing tape from being easily removed from a cartridge before the cartridge is mounted into the main assembly of an electrophotographic image forming apparatus for the very first time. Therefore it prevents the developer in the cartridge from leaking before the cartridge is mounted into the apparatus main assembly for the very first time. Further, it makes it possible to reduce in size an electrophotographic image forming apparatus in which the above described cartridge is removably mountable.

While the invention has been described with reference to the structures disclosed herein, it is not confined to the details set forth, and this application is intended to cover such modifications or changes as may come within the purposes of the improvements or the scope of the following claims.

What is claimed is:

1. A cartridge detachably mountable to a main assembly of an electrophotographic image forming apparatus, said cartridge comprising:

a developer accommodating portion configured to accommodate a developer;

a developer supply port configured and positioned to supply the developer to developing means for developing an electrostatic latent image formed on an electrophotographic photosensitive member;

a removable sealing tape configured and positioned to seal said developer supply port;

a covering member which is capable of assuming an opening position for opening said developer supply port and a closing position for closing said developer supply port and to which one longitudinal end of said sealing tape is fixed, wherein said covering member is effective to cover said sealing tape sealing said developer supply port when said covering member is at the closing position; and a cartridge locking portion configured and positioned to lock said covering member when said covering member is at the closing position;

wherein when said cartridge is mounted to the main assembly of the apparatus, locking between said cartridge locking portion and said covering member is released by engagement between said covering member and the main assembly of the apparatus, and said covering member moves from said closing position to said opening position, and said sealing tape is removed from said developer supply port to open said developer supply port.

2. A cartridge according to claim 1, wherein said covering member includes a cover side locking portion configured and positioned to lock said cartridge locking portion.

3. A cartridge according to claim 2, wherein said cover side locking portion is locked with a guide portion provided in said cartridge to guide movement of said covering member between the closing position and the opening position.

4. A cartridge according to claim 2, wherein said cover side locking portion includes:

a first inclined surface inclined in a direction of permitting movement of said covering member from the closing position to the opening position, wherein said first inclined surface is effective to release locking between said cartridge locking portion and said cover side locking portion when said covering member moves from the closing position to the opening position; and a second inclined surface inclined in a direction of permitting movement of said covering member from the opening position to the closing position, wherein said second inclined surface is effective to release locking between said cartridge locking portion and said cover side locking portion when said covering member moves from the opening position to the closing position.

5. A cartridge according to claim 1, wherein said cartridge locking portion includes:

a first inclined surface inclined in a direction of permitting movement of said covering member from the closing position to the opening position, said first inclined surface being effective to release locking between said cartridge locking portion and said covering member when covering member moves from the closing position to the opening position; and a second inclined surface inclined in a direction of permitting movement of said covering member from the opening position to the closing position, wherein said second inclined surface is effective to release locking between said cartridge locking portion and said covering member when said covering member moves from the opening position to the closing position.

6. A cartridge according to claim 1, wherein said covering member includes a portion to be urged by a projection provided in the main assembly of the apparatus when said cartridge is mounted to the main assembly of the apparatus.

7. A cartridge according to claim 6, wherein said cartridge locking portion is disposed substantially on an extension line extending in a direction of urging of said portion to be urged by the projection.

8. A cartridge according to claim 1, wherein locking between said cartridge locking portion and said covering member is released by elastic deformation of said covering member when locking between said cartridge locking portion and said covering member is released.

9. A cartridge according to claim 1, wherein locking between said cartridge locking portion and said covering member is released by elastic deformation of said cartridge locking portion when locking between said cartridge locking portion and said covering member is released.

10. A cartridge according to claim 1, wherein said cartridge locking portion is provided at each of a plurality of positions.

11. A cartridge according to claim 1, wherein a force applied to said covering member to release locking between said cartridge locking portion and said covering member is 29.4N–58.8N.

12. An electrophotographic image forming apparatus for forming an image on a recording material, to which a cartridge is detachably mountable, said apparatus comprising:

(i) a mounting device configured and positioned to detachably mount the cartridge, which includes a developer accommodating portion configured and positioned to accommodate a developer; a developer supply port configured and positioned to supply the developer to developing means for developing an electrostatic latent image formed on an electrophotographic photosensitive member; a removable sealing tape configured and positioned to seal the developer supply port; a covering member which is capable of assuming an opening position for opening the developer supply port and a closing position for closing the developer supply port and to which one longitudinal end of the sealing tape is fixed, the covering member being effective to cover the sealing tape sealing the developer supply port when it is at the closing position; and a cartridge locking portion configured and positioned to lock the covering member at the closing position; and (ii) a feeding device configured and positioned to feed the recording material, wherein when the cartridge is mounted to a main assembly of said apparatus, locking between the cartridge locking portion and the covering member is released by engagement between the covering member and the main assembly of said apparatus, and the covering member moves from the closing position to the opening position, and the sealing tape is removed from the developer supply port to open the developer supply port.

13. An apparatus according to claim 12, further comprising a projection configured and positioned to urge a portion to be urged provided in the covering member when the cartridge is mounted to the main assembly of said apparatus.

14. An apparatus according to claim 12, further comprising a releasing portion configured and positioned to release locking with the cartridge locking portion by elastic deformation of the covering member when the cartridge is mounted to the main assembly of said apparatus.

15. An apparatus according to claim 13, wherein said projection urges the portion to be urged provided in the covering member at a position adjacent the cartridge locking portion.

* * * * *

UNITED STATES PATENT AND TRADEMARK OFFICE

CERTIFICATE OF CORRECTION

PATENT NO. : 6,968,147 B2
APPLICATION NO. : 10/670235
DATED : November 22, 2005
INVENTOR(S) : Matsuda et al.

It is certified that error appears in the above-identified patent and that said Letters Patent is hereby corrected as shown below:

COLUMN 2
Line 9, “movement,” should read --movement--.
Line 21, “removably” should read --removable--.

COLUMN 3
Line 9, “its” should read --it--.

COLUMN 16
Line 24, “marks” should read --mark--.

COLUMN 17
Line 22, “firs” should read --first--.

COLUMN 19
Line 53, “containers.” should read --container.--.

COLUMN 24
Line 19, “when” should read --when said--.

Signed and Sealed this

Twenty-second Day of August, 2006

JON W. DUDAS
*Director of the United States Patent and Trademark Office*